US009366462B2

(12) United States Patent
Perevozchikov et al.

(10) Patent No.: US 9,366,462 B2
(45) Date of Patent: Jun. 14, 2016

(54) COMPRESSOR ASSEMBLY WITH DIRECTED SUCTION

(71) Applicant: Emerson Climate Technologies, Inc., Sidney, OH (US)

(72) Inventors: Michael M. Perevozchikov, Tipp City, OH (US); Roy J. Doepker, Lima, OH (US); Matthew Thomas Piscopo, Troy, OH (US); Eric P. Cavender, Troy, OH (US); Brian L. Reid, Fletcher, OH (US); Kevin J. Gehret, Fort Loramie, OH (US); Stephen Barry Tummino, Marysville, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 53 days.

(21) Appl. No.: 14/025,887

(22) Filed: Sep. 13, 2013

(65) Prior Publication Data

US 2014/0069139 A1 Mar. 13, 2014

Related U.S. Application Data

(60) Provisional application No. 61/761,378, filed on Feb. 6, 2013, provisional application No. 61/700,625, filed on Sep. 13, 2012.

(51) Int. Cl.
*F01C 21/18* (2006.01)
*F03C 2/24* (2006.01)
(Continued)

(52) U.S. Cl.
CPC ..... *F25B 31/006* (2013.01); *F04B 39/0061* (2013.01); *F04B 39/06* (2013.01);
(Continued)

(58) Field of Classification Search
CPC .. F04B 39/0055; F04B 39/12; F04C 18/0215; F04C 23/008; F04C 29/12
USPC ..... 418/180, 55.1–55.5; 285/192
See application file for complete search history.

(56) References Cited

U.S. PATENT DOCUMENTS 1,365,530 A * 1/1921 Moore ..... F16L 21/04 277/620
2,142,452 A * 1/1939 Merrill ..... F16L 41/12 200/84 R
(Continued)

FOREIGN PATENT DOCUMENTS

EP 0529660 A1 3/1993
JP H11-141470 A 5/1999
(Continued)

OTHER PUBLICATIONS

International Search Report regarding Application No. PCT/US2013/059612, mailed Dec. 9, 2013.
(Continued)

*Primary Examiner* — Kenneth Bomberg
*Assistant Examiner* — Deming Wan
(74) *Attorney, Agent, or Firm* — Harness, Dickey & Pierce, P.L.C.

(57) ABSTRACT

A compressor may include a shell assembly, a compression mechanism and a conduit. The shell assembly may include a fitting through which fluid is received from outside of the compressor. The compression mechanism may be disposed within a chamber defined by the shell assembly. The conduit may extend through the chamber between the fitting and a suction inlet of the compression mechanism and transmit at least a portion of the fluid from the fitting to the suction inlet. The conduit may include an inlet that may be spaced apart from the fitting and an outlet that may engage the compression mechanism.

14 Claims, 33 Drawing Sheets

(51) Int. Cl.

| | |
|---|---|
| ***F03C 4/00*** | (2006.01) |
| ***F04C 29/12*** | (2006.01) |
| ***F01C 1/02*** | (2006.01) |
| ***F01C 1/063*** | (2006.01) |
| ***F25B 31/00*** | (2006.01) |
| ***F04B 39/06*** | (2006.01) |
| ***F04B 39/00*** | (2006.01) |
| ***F04B 39/12*** | (2006.01) |
| ***F04C 23/00*** | (2006.01) |
| ***F04C 18/02*** | (2006.01) |

(52) U.S. Cl.

CPC ..... *F04B 39/123* (2013.01); *F04C 18/0215* (2013.01); *F04C 23/008* (2013.01); *F04C 29/12* (2013.01); *F25B 2309/06* (2013.01)

(56) References Cited

U.S. PATENT DOCUMENTS

| | | | | |
|---|---|---|---|---|
| 2,157,918 | A * | 5/1939 | Rankin | 285/192 |
| 4,313,715 | A | 2/1982 | Richardson, Jr. | |
| 4,343,599 | A | 8/1982 | Kousokabe | |
| 4,365,941 | A | 12/1982 | Tojo et al. | |
| 4,412,791 | A | 11/1983 | Lal | |
| 4,496,293 | A | 1/1985 | Nakamura et al. | |
| 4,564,339 | A | 1/1986 | Nakamura et al. | |
| 4,592,703 | A | 6/1986 | Inaba et al. | |
| 4,609,334 | A | 9/1986 | Muir et al. | |
| 4,696,629 | A | 9/1987 | Shiibayashi et al. | |
| 4,759,696 | A | 7/1988 | Ishiai | |
| 4,838,769 | A | 6/1989 | Gannaway | |
| 5,007,809 | A | 4/1991 | Kimura et al. | |
| 5,114,322 | A | 5/1992 | Caillat et al. | |
| 5,219,281 | A | 6/1993 | Caillat et al. | |
| 5,240,391 | A * | 8/1993 | Ramshankar et al. | 417/410.1 |
| 5,306,126 | A | 4/1994 | Richardson, Jr. | |
| 5,366,352 | A | 11/1994 | Deblois et al. | |
| 5,435,700 | A | 7/1995 | Park | |
| 5,531,078 | A | 7/1996 | Day et al. | |
| 5,533,875 | A | 7/1996 | Crum et al. | |
| 5,772,411 | A | 6/1998 | Crum et al. | |
| 6,000,917 | A | 12/1999 | Smerud et al. | |
| 6,017,205 | A * | 1/2000 | Weatherston et al. | 418/55.6 |
| 6,174,150 | B1 | 1/2001 | Tsubono et al. | |
| 6,244,834 | B1 | 6/2001 | Matsuda et al. | |
| 6,261,071 | B1 | 7/2001 | Williams et al. | |
| 6,352,418 | B1 | 3/2002 | Kohsokabe et al. | |
| 6,402,485 | B2 | 6/2002 | Hong et al. | |
| 6,474,964 | B2 | 11/2002 | De Bernardi et al. | |
| 6,685,441 | B2 | 2/2004 | Nam | |
| 6,709,244 | B2 | 3/2004 | Pham | |
| 6,736,607 | B2 | 5/2004 | Ginies et al. | |
| 6,857,808 | B1 * | 2/2005 | Sugimoto et al. | 403/41 |
| 7,108,494 | B2 | 9/2006 | Nam | |
| 7,147,443 | B2 | 12/2006 | Ogawa et al. | |
| 7,207,787 | B2 | 4/2007 | Liang et al. | |
| 7,311,501 | B2 | 12/2007 | Wehrenberg et al. | |
| RE40,830 | E | 7/2009 | Caillat | |
| 7,699,589 | B2 | 4/2010 | Terauchi et al. | |
| 7,708,536 | B2 | 5/2010 | Ginies et al. | |
| 7,771,180 | B2 | 8/2010 | Cho et al. | |
| 7,905,715 | B2 | 3/2011 | Hiwata et al. | |
| 8,133,043 | B2 | 3/2012 | Duppert | |
| 2006/0275150 | A1 * | 12/2006 | Barth | 417/312 |
| 2009/0229303 | A1 | 9/2009 | Iversen et al. | |
| 2012/0134859 | A1 | 5/2012 | Duppert | |
| 2012/0148433 | A1 | 6/2012 | Liang et al. | |
| 2013/0026749 | A1 * | 1/2013 | O'Brien | B60R 13/0876 285/62 |
| 2013/0039792 | A1 | 2/2013 | Hiratsuka et al. | |
| 2013/0089451 | A1 | 4/2013 | Ahn et al. | |
| 2013/0108496 | A1 | 5/2013 | Nakai et al. | |
| 2013/0129549 | A1 | 5/2013 | Sakuda et al. | |

FOREIGN PATENT DOCUMENTS

| | | | |
|---|---|---|---|
| JP | 2003120539 | A | 4/2003 |
| JP | 2005188353 | A | 7/2005 |
| WO | WO-2008102940 | A1 | 8/2008 |
| WO | 2011147005 | A1 | 12/2011 |

OTHER PUBLICATIONS

Written Opinion of the International Searching Authority regarding Application No. PCT/US2013/059612, mailed Dec. 9, 2013.

* cited by examiner

COMPRESSOR ASSEMBLY WITH DIRECTED SUCTION

CROSS-REFERENCE TO RELATED APPLICATIONS

This application claims the benefit of U.S. Provisional Application No. 61/761,378, filed on Feb. 6, 2013 and U.S. Provisional Application No. 61/700,625, filed on Sep. 13, 2012. The entire disclosures of each of the above applications are incorporated herein by reference.

FIELD

The present disclosure relates to a compressor assembly with directed suction.

BACKGROUND

This section provides background information related to the present disclosure and is not necessarily prior art.

A compressor may be incorporated into a heating and/or cooling system and may include a shell containing a compression mechanism and a motor driving the compression mechanism. In some compressors, the shell defines a suction chamber into which a relatively low-pressure working fluid is drawn. The motor and the compression mechanism may be disposed in the suction chamber. The low-pressure working fluid drawn into the suction chamber may absorb heat from the motor before being drawn into the compression mechanism. Cooling the motor in this manner elevates a temperature of the working fluid which may hinder a heating and/or cooling capacity or efficiency of the heating and/or cooling system.

SUMMARY

This section provides a general summary of the disclosure, and is not a comprehensive disclosure of its full scope or all of its features.

In one form, the present disclosure provides a compressor that may include a shell assembly, a compression mechanism and a conduit. The shell assembly may include an opening through which fluid is received from outside of the compressor. The fluid may include at least one of a working fluid and a lubricant. The compression mechanism may be disposed within a chamber defined by the shell assembly. The conduit may extend through the chamber between the opening and a suction inlet of the compression mechanism and may transmit at least a portion of the fluid from the opening to the suction inlet. The compressor may be a low-side compressor and may include means for allowing a selected amount of the fluid to enter the chamber without first entering the suction inlet.

In another form, the present disclosure provides a compressor that may include a shell assembly, a compression mechanism and a conduit. The shell assembly may include a fitting through which fluid is received from outside of the compressor. The compression mechanism may be disposed within a chamber defined by the shell assembly. The conduit may extend through the chamber between the fitting and a suction inlet of the compression mechanism and transmit at least a portion of the fluid from the fitting to the suction inlet. The conduit may include an inlet that may be spaced apart from the fitting and an outlet that may engage the compression mechanism.

In some embodiments, the conduit may include an aperture spaced apart from the inlet and the outlet and may provide fluid communication between the conduit and the chamber.

In some embodiments, the conduit may be spaced apart from the fitting and the shell assembly.

In some embodiments, the conduit may include a centerline or longitudinal axis extending through a center of the inlet and a center of the outlet.

In some embodiments, the centerline may intersect a spiral wrap of the compression mechanism.

In some embodiments, the outlet may be tangent to a spiral wrap of the compression mechanism.

In some embodiments, the outlet may snap into engagement with the suction inlet.

In some embodiments, the conduit may include a bulged portion. The inlet may be disposed between the bulged portion and a longitudinal axis of the shell assembly.

In some embodiments, the conduit may include an integrally formed rib extending outward therefrom.

In some embodiments, the rib may be disposed proximate the outlet and between a pair of mounting apertures in the conduit.

In another form, the present disclosure provides a compressor that may include a shell assembly, a compression mechanism and a conduit. The shell assembly may include a fitting through which fluid is received from outside of the compressor. The compression mechanism may be disposed within a chamber defined by the shell assembly. The conduit may extend through the chamber between the fitting and a suction inlet of the compression mechanism and transmit at least a portion of the fluid from the fitting to the suction inlet. The conduit may include an inlet that may be adjacent the fitting and an outlet that may be tangent to a spiral wrap of the compression mechanism.

In some embodiments, the conduit may include an aperture spaced apart from the inlet and the outlet and providing fluid communication between the conduit and the chamber.

In some embodiments, the conduit may be spaced apart from the fitting and the shell assembly.

In some embodiments, the conduit may include a centerline extending through a center of the outlet and intersecting a spiral wrap of the compression mechanism.

In some embodiments, the outlet may snap into engagement with the suction inlet.

In another form, the present disclosure provides a compressor that may include a shell assembly, a compression mechanism and a conduit. The shell assembly may include a fitting through which fluid is received from outside of the compressor. The compression mechanism may be disposed within a chamber defined by the shell assembly. The conduit may extend through the chamber between the fitting and a suction inlet of the compression mechanism and transmit at least a portion of the fluid from the fitting to the suction inlet. The conduit may include an inlet that may be spaced apart from the fitting and the shell assembly and an outlet that may be adjacent the compression mechanism. The outlet may include a centerline extending through a spiral wrap of the compression mechanism.

In some embodiments, the conduit may include an aperture spaced apart from the inlet and the outlet and providing fluid communication between the conduit and the chamber.

In some embodiments, the outlet may be tangent to the spiral wrap.

In some embodiments, the centerline may extend through a center of the inlet.

In some embodiments, the outlet may snap into engagement with the suction inlet.

In another form, the present disclosure provides a compressor that may include a shell assembly, a compression mechanism and a conduit. The shell assembly may include a fitting through which fluid is received from outside of the compressor. The compression mechanism may be disposed within a chamber defined by the shell assembly. The conduit may extend through the chamber between the fitting and a suction inlet of the compression mechanism and may transmit at least a portion of the fluid from the fitting to the suction inlet. The conduit may include an inlet adjacent the fitting and an outlet spaced apart from the suction inlet. The outlet may include a centerline extending through a spiral wrap of the compression mechanism.

In some embodiments, the centerline may extend through a center of the inlet.

In some embodiments, the inlet may directly or indirectly engage the fitting.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
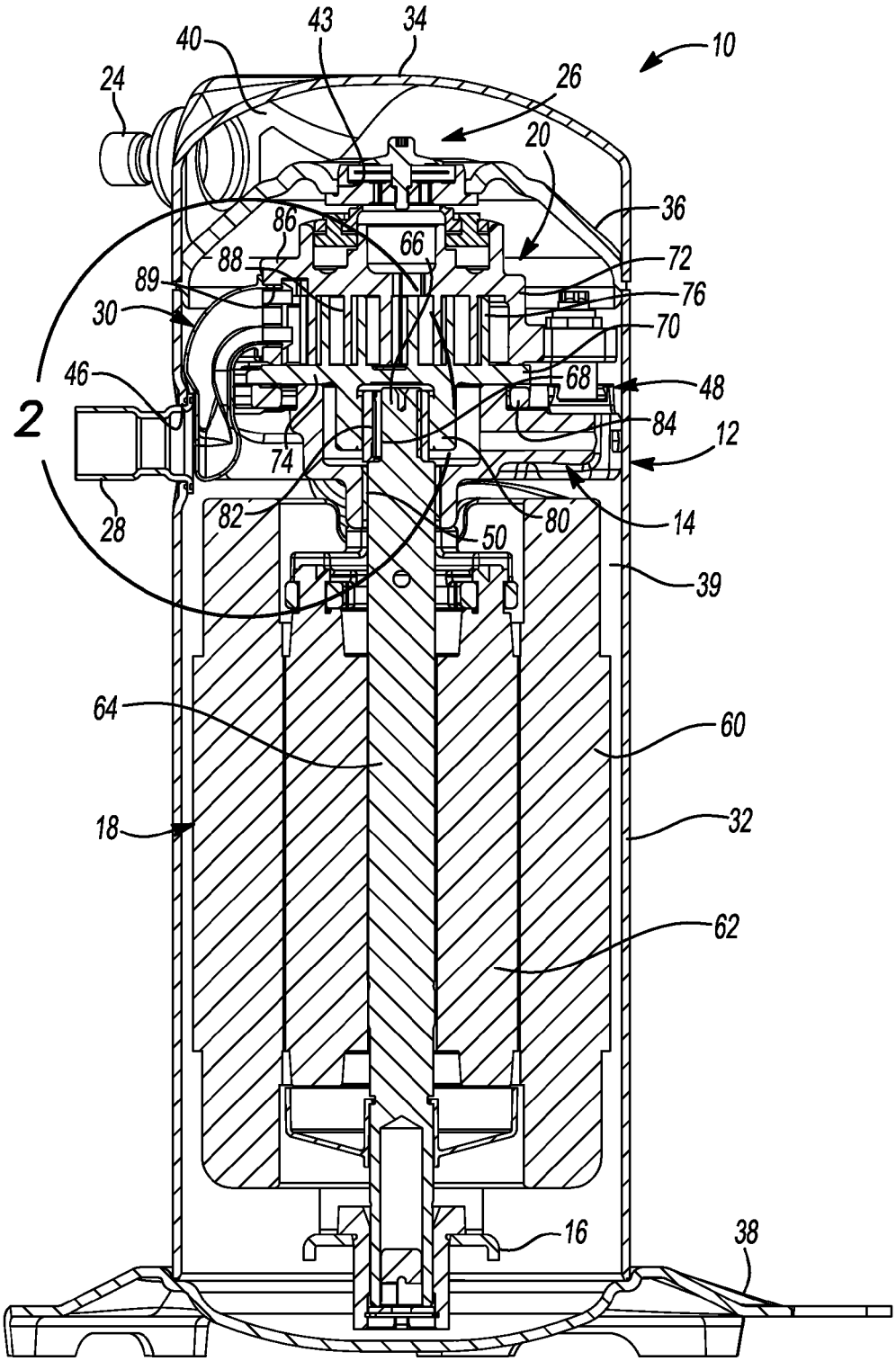
FIG. 1 is a cross-sectional view of a compressor having a suction conduit according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, a compressor 10 is provided and may include a hermetic shell assembly 12, first and second bearing housing assemblies 14, 16, a motor assembly 18, a compression mechanism 20, a discharge port or fitting 24, a discharge valve assembly 26, a suction port or fitting 28, and a suction conduit 30.

The shell assembly 12 may form a compressor housing and may include a cylindrical shell 32, an end cap 34 at an upper end thereof, a transversely extending partition 36, and a base 38 at a lower end thereof. The shell 32 and base 38 may cooperate to define a suction-pressure chamber 39 The end cap 34 and the partition 36 may define a discharge-pressure chamber 40. The partition 36 may separate the discharge chamber 40 from the suction-pressure chamber 39. A discharge-pressure passage 43 may extend through the partition 36 to provide communication between the compression mechanism 20 and the discharge-pressure chamber 40. The discharge valve assembly 26 may be disposed within the discharge-pressure passage 43 and may generally prevent a reverse flow condition (i.e., flow from the discharge chamber 40 to the suction-pressure chamber 39. The suction fitting 28 may be attached to shell assembly 12 at an opening 46.

The first bearing housing assembly 14 may be disposed within the suction-pressure chamber and may be fixed relative to the shell 32. The first bearing housing assembly 14 may include a first bearing housing 48 and a first bearing 50. The main bearing housing 48 may house the first bearing 50 therein. The main bearing housing 48 may fixedly engage the shell 32 and may axially support the compression mechanism 20.

The motor assembly 18 may be disposed within the suction-pressure chamber 39 and may include a stator 60 and a rotor 62. The stator 60 may be press fit into the shell 32. The rotor 62 may be press fit on the drive shaft 64 and may transmit rotational power to the drive shaft 64. The drive shaft 64 may be rotatably supported by the first and second bearing housing assemblies 14, 16. The drive shaft 64 may include an eccentric crank pin 66 having a crank pin flat 68.

The compression mechanism 20 may be disposed within the suction-pressure chamber 39 and may include an orbiting scroll 70 and a non-orbiting scroll 72. The orbiting scroll 70 may include an end plate 74 and a spiral wrap 76 extending therefrom. A cylindrical hub 80 may project downwardly from the end plate 74 and may include a drive bushing 82 disposed therein. The drive bushing 82 may include an inner bore (not numbered) in which the crank pin 66 is drivingly disposed. The crank pin flat 68 may drivingly engage a flat surface in a portion of the inner bore to provide a radially compliant driving arrangement. An Oldham coupling 84 may be engaged with the orbiting and non-orbiting scrolls 70, 72 to prevent relative rotation therebetween.

The non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets. The fluid pockets defined by the spiral wraps 76, 88 may decrease in volume as they move from a radially outer position (at a suction pressure) to a radially intermediate position (at an intermediate pressure) to a radially inner position (at a discharge pressure) throughout a compression cycle of the compression mechanism 20. A suction inlet 89 may be formed in the non-orbiting scroll 72 and may provide fluid communication between the suction conduit 30 and a radially outermost fluid pocket formed by the spiral wraps 76, 88. A shown in FIGS. 1 and 2, the suction fitting 28 may be axially misaligned with the suction inlet 89. In other embodiments, the suction inlet 89 and the suction fitting 28 could be substantially axially aligned with each other (i.e., at the same vertical height).

The suction conduit 30 may be a hollow member that directs a working fluid (e.g., refrigerant or carbon dioxide) at a suction-pressure from the suction fitting 28 to the suction inlet 89 of the non-orbiting scroll 72. The suction conduit 30 may be injection molded or otherwise formed from a polymeric or metallic material and may include an inlet portion 90, a body 92 and an outlet portion 94. The inlet portion 90 may have a partial-hemispherical shape and may include an inlet opening 96 and an aperture 98. The inlet portion 90 may be disposed adjacent to and slightly spaced apart from the suction fitting 28 and may be positioned such that the inlet opening 96 is generally concentrically aligned with the suction fitting 28. The inlet opening 96 may receive the working fluid from the suction fitting 28. The aperture 98 may be angled relative to the inlet opening 96 and may provide fluid communication between the suction conduit 30 and the suction-pressure chamber 39.

The body 92 may be flared outward from the inlet portion 90 and the outlet portion 94. The shape of the body 92 may be designed such that the cross-sectional area of the body 92 is approximately equal to the cross-sectional areas of the inlet portion 90 and outlet portion 94. This is, the cross-sectional area of the suction conduit 30 may remain substantially constant between the inlet portion 90 and the outlet portion 94. In this manner, a flow of fluid through the suction conduit 30 is not significantly restricted in the body 92, but the body 92 can still fit into a relatively small space between the shell 32 and the orbital path of the orbiting scroll 70. It will be appreciated that the body 92 may include any shape suited for a given application. For example, in some embodiments, the suction conduit 30 may be substantially tubular with substantially constant inner and outer diameters.

Figure 2:
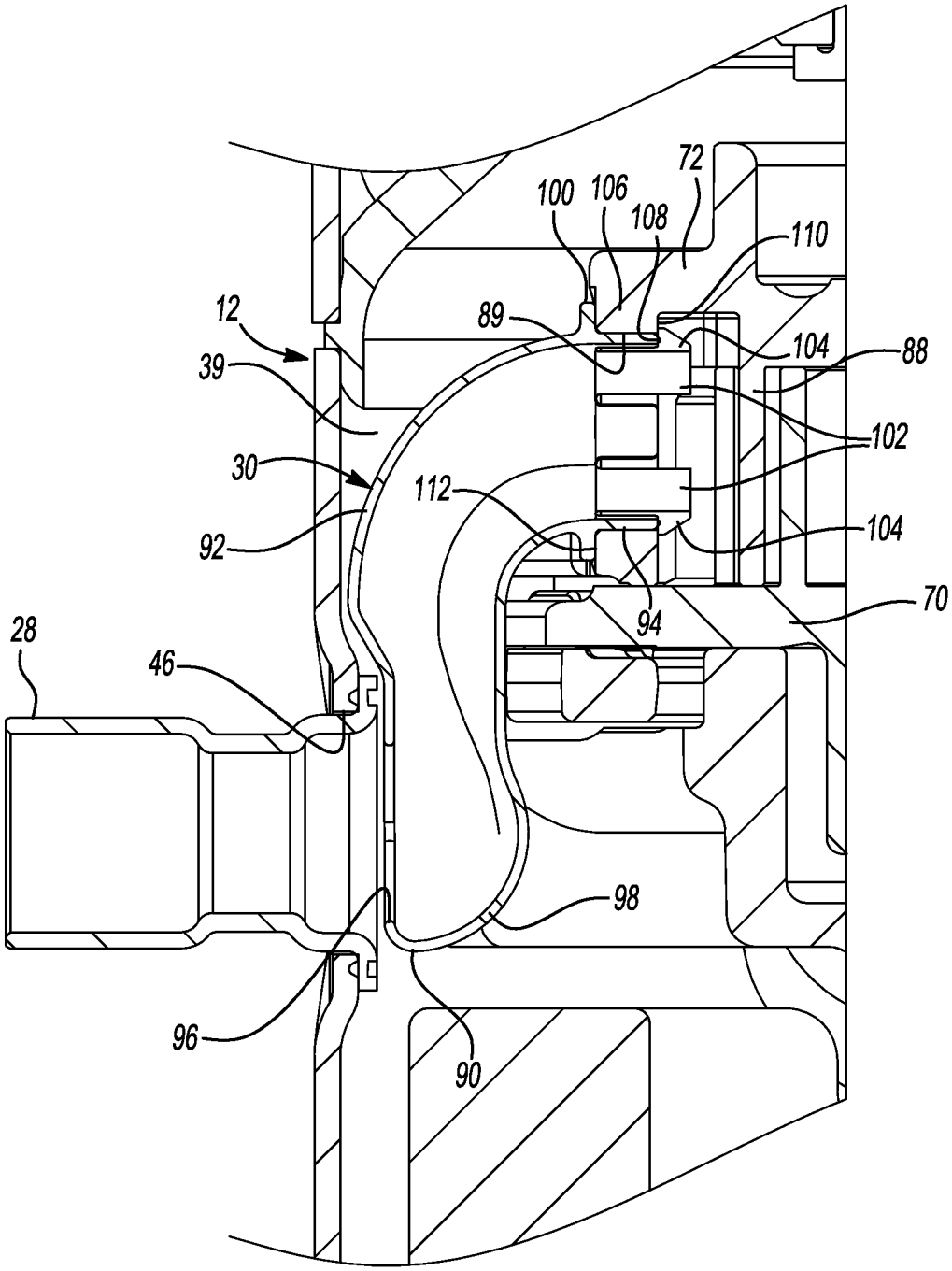
FIG. 2 is a partial cross-sectional view of the compressor of FIG. 1 illustrating the suction conduit in more detail.
Figure 3:
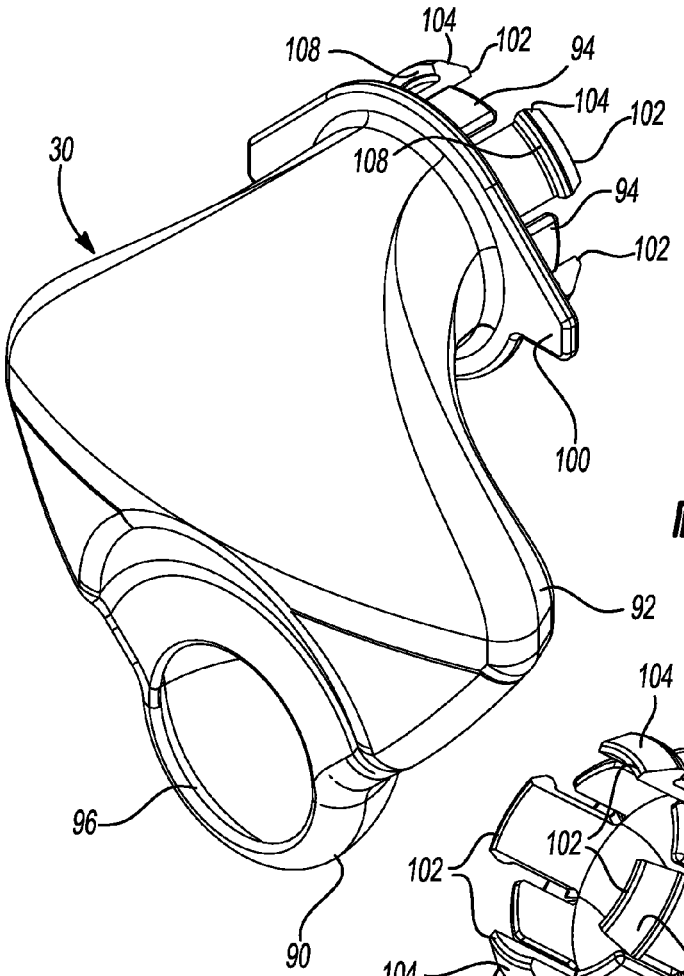
FIG. 3 is a perspective view of the suction conduit.
Figure 4:
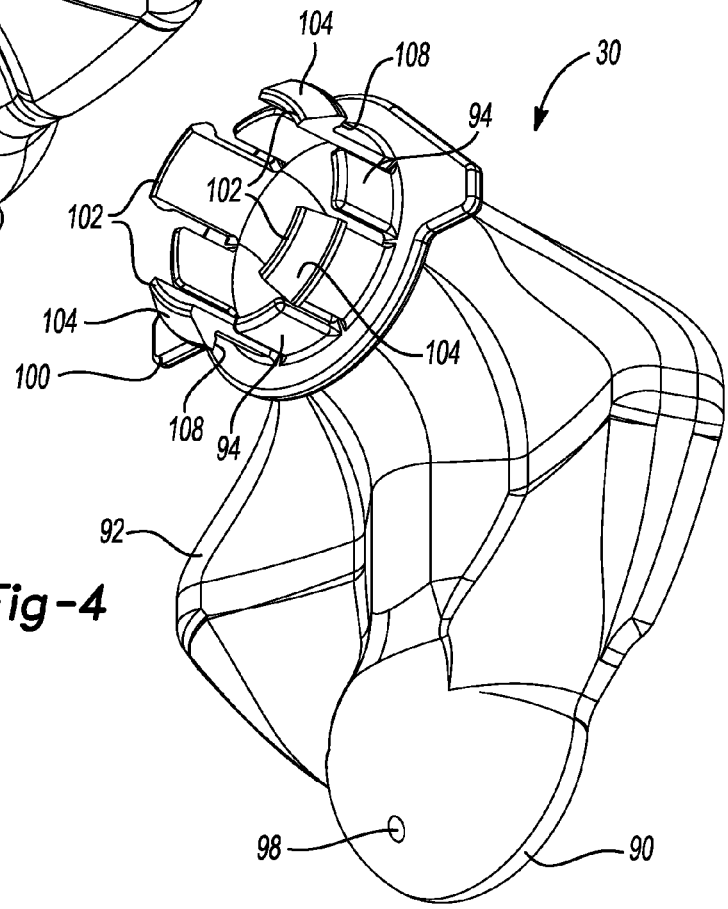
FIG. 4 is another perspective view of the suction conduit.

The outlet portion 94 can be generally tubular, for example, and may include an outwardly extending flange 100 and a plurality of resiliently flexible tabs 102 having barbed tips 104. The outlet portion 94 may be received into the suction inlet 89 and may snap into engagement with a wall 106 of the non-orbiting scroll 72 that defines the suction inlet 89. As shown in FIG. 2, when the outlet portion 94 is fully engaged with the suction inlet 89, an engagement surface 108 of each barbed tip 104 may abut an inner surface 110 of the wall 106, and the flange 100 may abut an outer surface 112 of the wall 106. In this manner, the suction conduit 30 may be fixed relative to the non-orbiting scroll 72. The inlet portion 90 can be slightly spaced apart from the suction fitting 28 and the shell 32 to allow for manufacturing tolerances and to prevent the suction conduit 30 from melting or warping due to brazing or welding operations during assembly of the shell assembly 12 and/or other components of the compressor 10.

With continued reference to FIGS. 1 and 2, operation of the compressor 10 will be described in detail. During operation of the compressor 10, electrical power may be supplied to the motor assembly 18, causing the rotor 62 to rotate and turn the drive shaft 64, which in turn causes the orbiting scroll 70 to orbit relative to the non-orbiting scroll 72. Orbital motion of the orbiting scroll 70 relative to the non-orbiting scroll 72 generates a vacuum at the suction inlet 89 which causes working fluid from outside of the shell assembly 12 to be drawn into the compressor 10 through the suction fitting 28.

From the suction fitting 28, the working fluid may flow into the inlet opening 96 of the inlet portion 90 of the suction conduit 30. A substantial majority of the working fluid may flow from the inlet portion 90 up through the body 92 and outlet portion 94 and into the suction inlet 89 for compression between the orbiting and non-orbiting scrolls 70, 72. The working fluid that flows from the suction fitting 28 directly into the suction conduit 30 and directly from the suction conduit 30 into the suction inlet 89 may be substantially isolated from heat generated by the motor assembly 18.

A relatively small amount of working fluid that flows into the suction conduit 30 through the inlet opening 96 may exit the suction conduit 30 through the aperture 98. From the aperture 98, the fluid may flow into the suction-pressure chamber 39 and may absorb heat from the motor assembly 18 and/or other components. This fluid may then reenter the suction conduit 30 through the inlet opening 96 and may flow into the suction inlet 89 and/or back through the aperture 98.

During an oil-charging operation, which may be a step in a process for manufacturing the compressor 10, a lubricant may be injected into the compressor 10 through the suction fitting 28 to lubricate and cool moving parts of the compressor 10. In a similar manner as described above, some of the lubricant may flow from the suction fitting 28 and through the suction conduit 30 to the suction inlet 89, and most of the lubricant in the suction conduit 30 may flow into the suction-pressure chamber 39 through the aperture 98. In this manner, lubricant may be distributed throughout the compressor 10 and may accumulate in a lubricant sump defined by the shell 32 and base 38. It may be desirable for most of the lubricant that enters the suction conduit 30 during the oil-charging operation to exit the suction conduit 30 through the aperture 98 and flow into the suction-pressure chamber 39, rather than flow into suction inlet 89, as at least some of the lubricant that enters the compression mechanism 20 may be pumped out of the compressor 10 upon start-up of the compressor 10.

Figure 5:
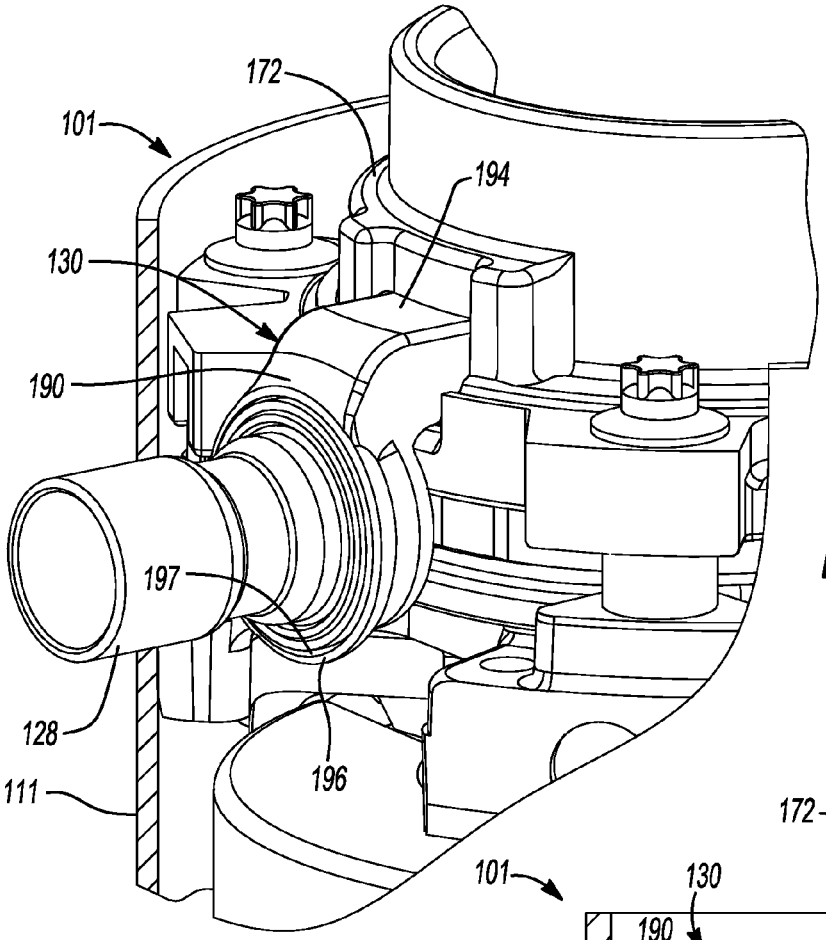
FIG. 5 is a partial perspective view of another compressor having another suction conduit according to the principles of the present disclosure.
Figure 6:
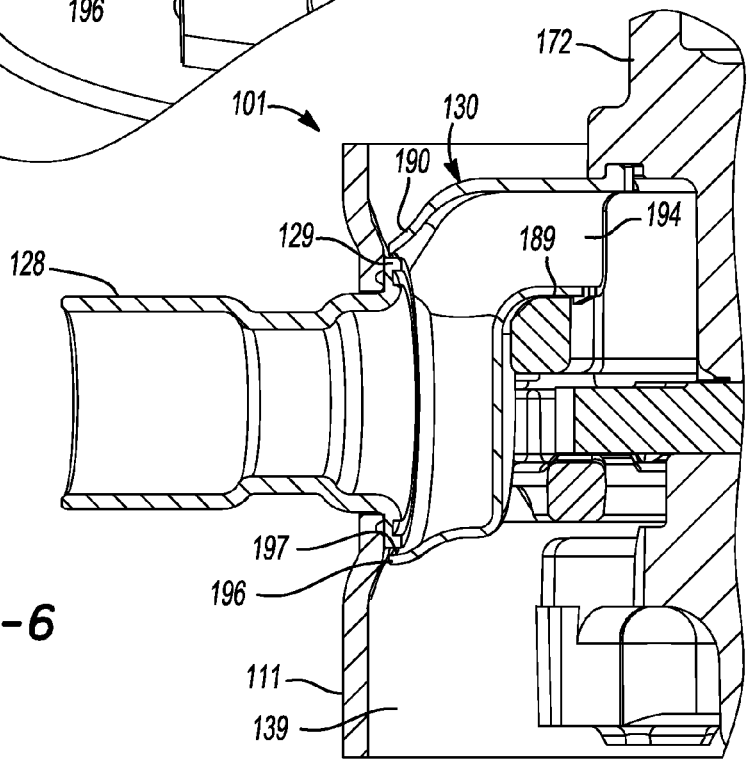
FIG. 6 is a partial cross-sectional view of the compressor of FIG. 5.

With reference to FIGS. 5 and 6, another compressor 101 is provided. The structure and function of the compressor 101 may be similar to that of the compressor 10. Therefore, similar components and features will not be described again in detail. Briefly, the compressor 101 may include a shell assembly 111, a suction fitting 128, a non-orbiting scroll 172 having a suction inlet 189, and a suction conduit 130. The suction conduit 130 may be in fluid communication with the suction fitting 128 and the suction inlet 189 and may route a substantial majority of working fluid entering the compressor 101 through the suction fitting 128 directly to the suction inlet 189 without absorbing a significant amount of heat from the motor assembly.

Like the suction conduit 30, the suction conduit 130 may be fixed to the non-orbiting scroll 172 and may be slightly spaced apart from the suction fitting 128 and shell assembly 111. An outlet portion 194 of the suction conduit 130 may snap into engagement with the suction inlet 189. An inlet opening 196 of the suction conduit 130 may have a larger diameter than a flange portion 129 of the suction fitting 128 such that an annular gap 197 is formed between the flange portion 129 and an inlet portion 190 of the suction conduit 130. Oil may drain out of the suction conduit 130 through the annular gap 197 and into a suction-pressure chamber 139 of the compressor 101. While not shown in the figures, the suction conduit 130 may include an aperture that, like the aperture 98 in the suction conduit 30, allows for some working fluid and/or lubricant in the suction conduit 130 to flow into the suction-pressure chamber 139.

Figure 7:
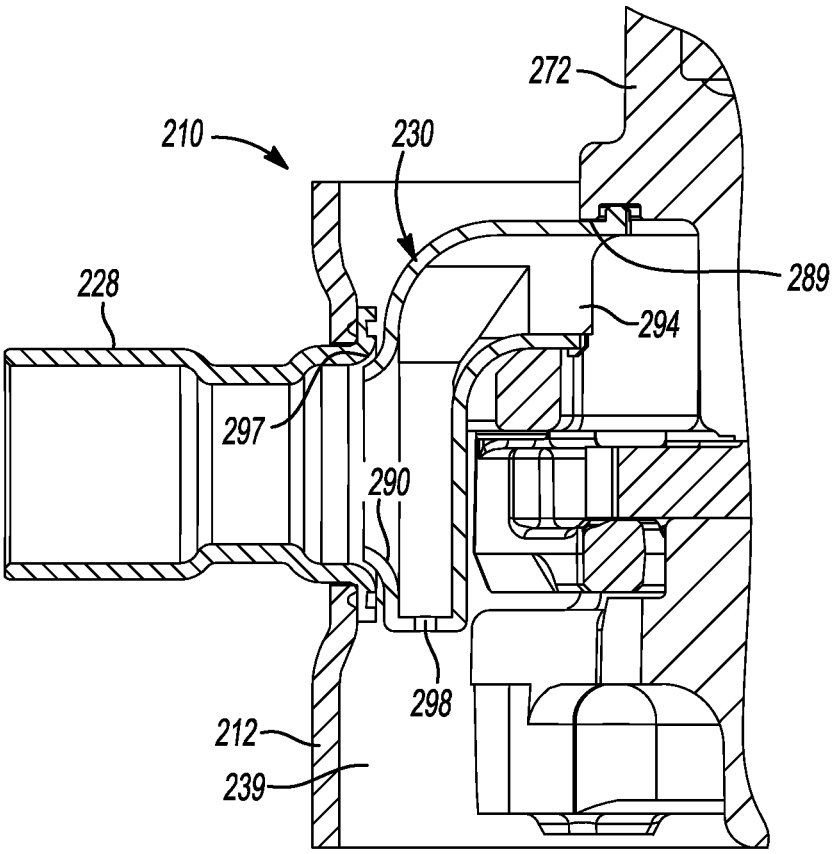
FIG. 7 is a partial cross-sectional view of another compressor having another suction conduit according to the principles of the present disclosure.

With reference to FIG. 7, another compressor 210 is provided that includes a suction conduit 230. The structure and function of the compressor 210 and suction conduit 230 may be similar to that of the compressors 10, 101 and suction conduits 30, 130. Therefore, similar components and features will not be described again in detail.

Like the suction conduits 30, 130, the suction conduit 230 may be fixed to a non-orbiting scroll 272 and may be slightly spaced apart from a suction fitting 228 and shell assembly 212. An outlet portion 294 of the suction conduit 230 may snap into engagement with a suction inlet 289 of the non-orbiting scroll 272. An inlet portion 290 of the suction conduit 230 may extend partially into the suction fitting 228 such that an annular gap 297 is formed therebetween. A relatively small amount of oil and/or suction-pressure working fluid may flow from the suction fitting 228 through the annular gap 297 and into a suction-pressure chamber 239 of the compressor 210. The suction conduit 230 may also include an aperture 298 that, like the aperture 98 in the suction conduit 30, allows for some working fluid and/or lubricant in the suction conduit 230 to flow into the suction-pressure chamber 239.

Figure 8:
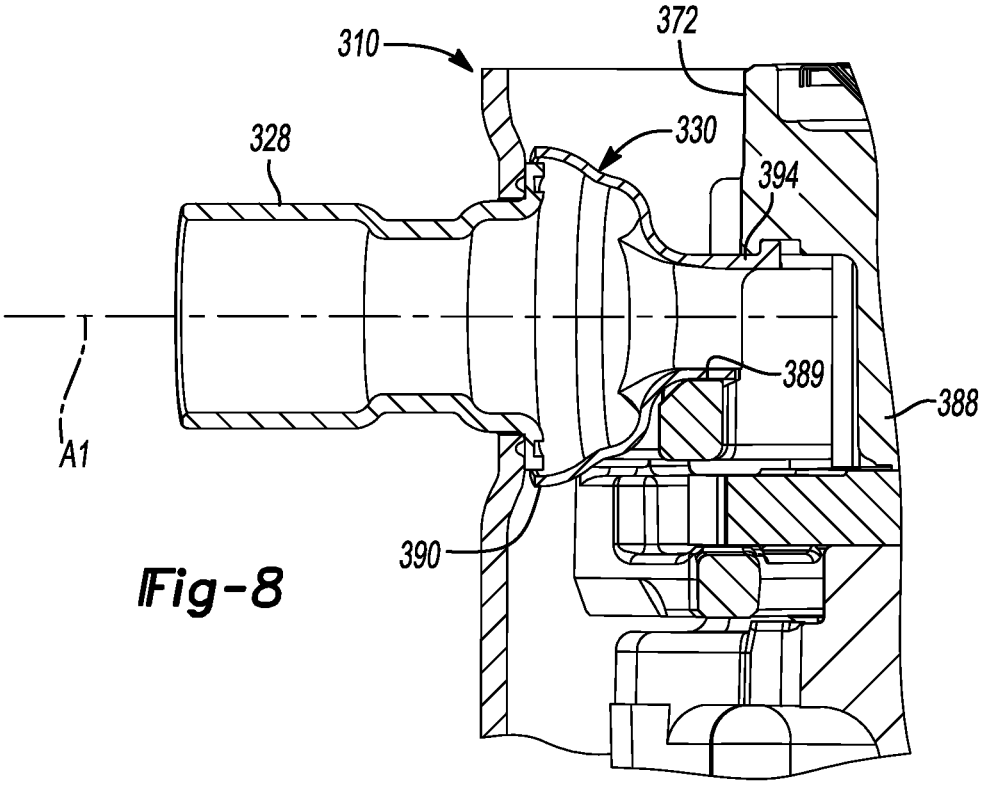
FIG. 8 is a partial cross-sectional view of another compressor having another suction conduit according to the principles of the present disclosure.

With reference to FIG. 8, another compressor 310 is provided that includes a suction fitting 328 and a suction conduit 330. The structure and function of the compressor 310, suction fitting 328 and suction conduit 330 may be similar to that of the compressor 101, suction fitting 128 and suction conduit 130, respectively. Therefore, similar components and features will not be described again in detail. Unlike the suction fitting 128, a longitudinal axis of the suction fitting 328 may be generally aligned with a suction inlet 389 in a non-orbiting scroll 372 of the compressor 310. Accordingly, an inlet portion 390 and an outlet portion 394 of the suction conduit 330 may be substantially concentric with each other. A centerline or longitudinal axis A1 of the suction conduit 330 may intersect a spiral wrap 388 of the non-orbiting scroll 372. In some embodiments, the suction conduit 330 may be generally tangent to the spiral wrap 388. In some embodiments, the longitudinal axis A1 of the suction conduit 330 may intersect the spiral wrap 388.

Figure 9:
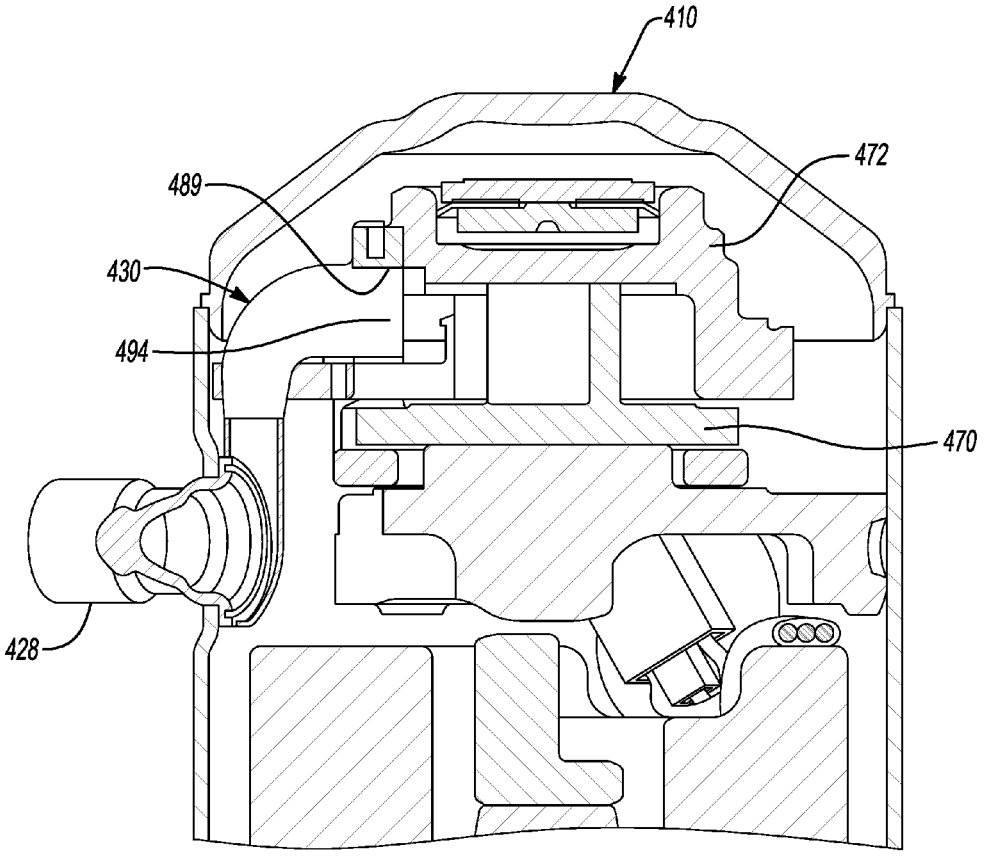
FIG. 9 is a partial cross-sectional view of another compressor having another suction conduit according to the principles of the present disclosure.
Figure 10:
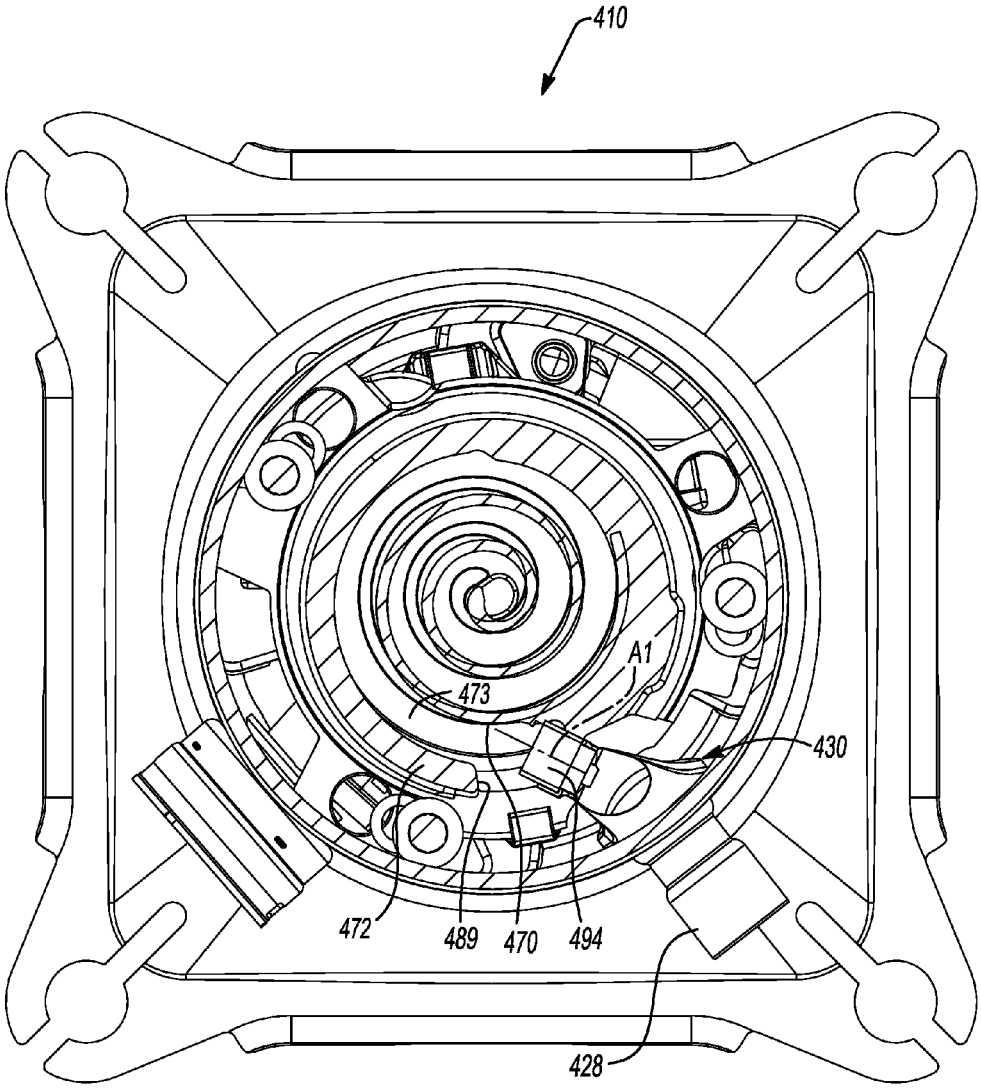
FIG. 10 is another partial cross-sectional view of the compressor of FIG. 9.

With reference to FIGS. 9 and 10, another compressor 410 is provided that includes a suction fitting 428 and a suction conduit 430. The structure and function of the compressor 410, suction fitting 428 and suction conduit 430 may be similar to that of any of the compressors, suction fittings and suction conduits, respectively, described above. Therefore, similar components and features will not be described again in detail. The suction conduit 430 may include an outlet portion 494 that may engage a non-orbiting scroll 472 via a snap fit, a fastener and/or any other suitable means to provide fluid communication between the suction fitting 428 and a suction inlet 489 of the non-orbiting scroll 472. As shown in FIG. 10, a longitudinal axis of the outlet portion 494 of the suction conduit 430 may be angled relative to a longitudinal axis of the suction fitting 428 such that working fluid may exit the suction conduit 430 and flow into a compression pocket 473 formed between the non-orbiting scroll 472 and orbiting scroll 470 tangentially or nearly tangentially relative to the compression pocket 473 or a spiral wrap of the orbiting scroll 470 or non-orbiting scroll 472.

Figure 11:
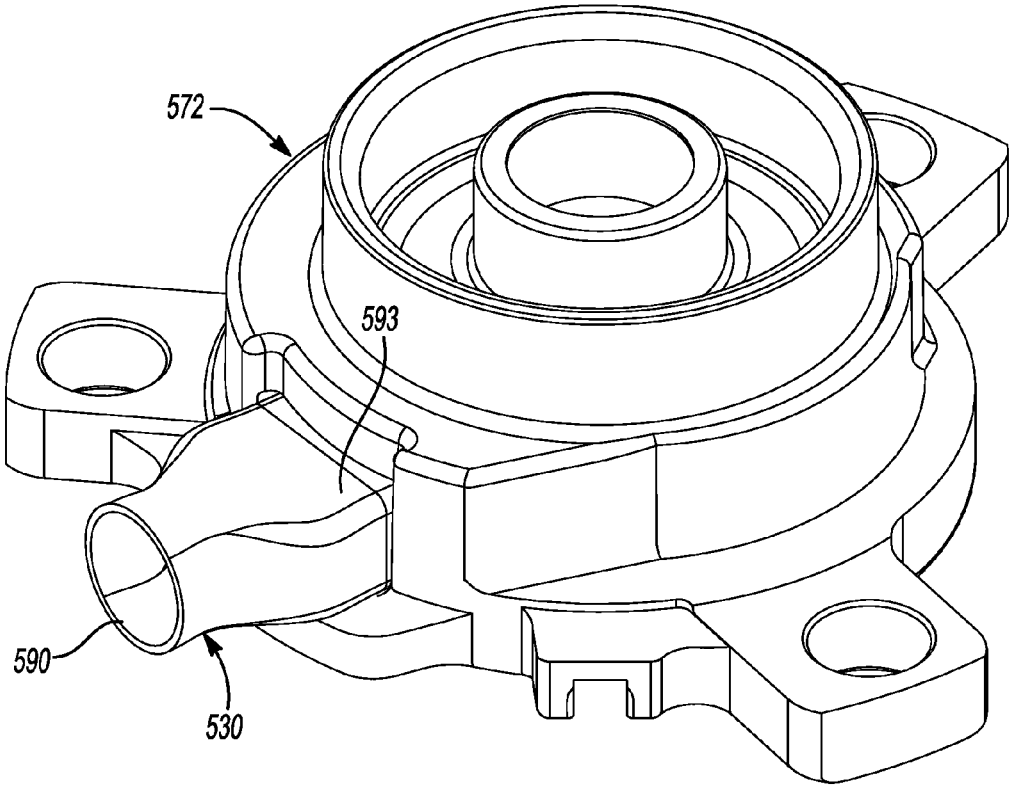
FIG. 11 is a perspective view of a non-orbiting scroll and another suction conduit according to the principles of the present disclosure.
Figure 12:
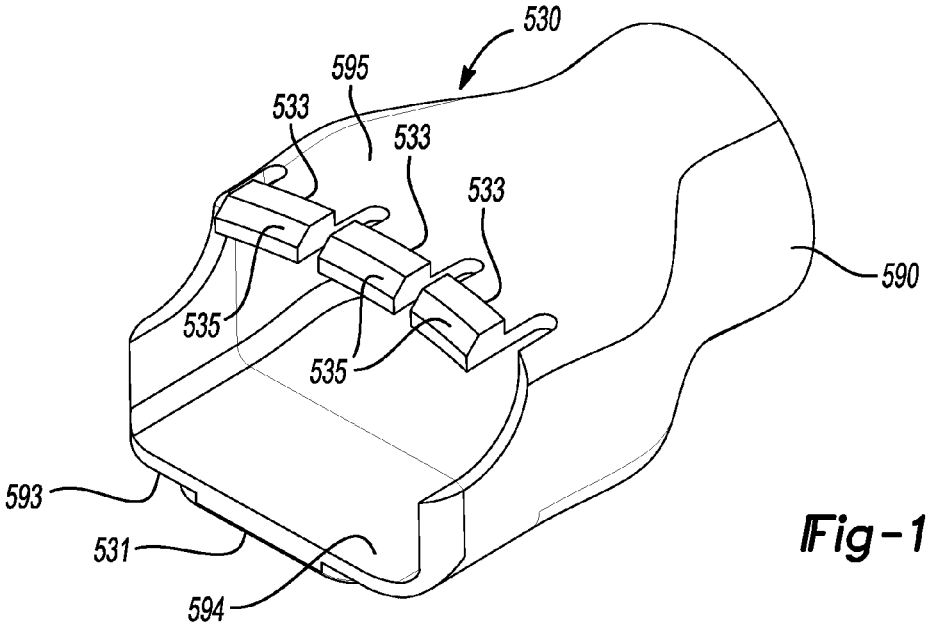
FIG. 12 is a perspective view of the suction conduit of FIG. 11.
Figure 13:
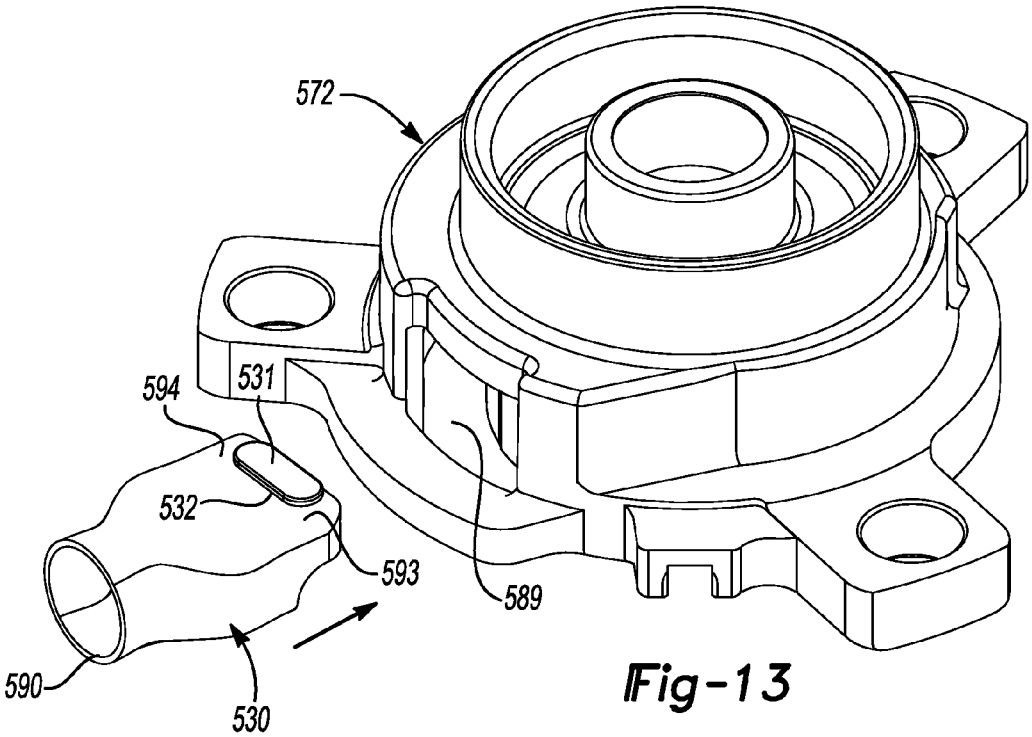
FIG. 13 is an exploded perspective view of the non-orbiting scroll and suction conduit of FIG. 11.

With reference to FIGS. 11-13, another non-orbiting scroll 572 and suction conduit 530 are provided. The structure and function of the non-orbiting scroll 572 and suction conduit 530 may be similar to that of any of the non-orbiting scrolls and suction conduits, respectively, described above. Therefore, similar components and features will not be described again in detail. It will be appreciated that the non-orbiting scroll 572 and suction conduit 530 could be incorporated into any of the compressors described above, for example.

The suction conduit 530 may include a generally tubular inlet portion 590 and a hollow outlet portion 594 having a generally rectangular cross section. The outlet portion 594 may include first and second opposing sides 593, 595. As shown in FIG. 13, the first side 593 may include a boss 531 extending outwardly therefrom. The boss 531 may include a generally oblong shape and may have a generally planar side 532 that is generally parallel to an edge of the first side 593. The second side 595 may include one or more resiliently flexible tabs 533. Each tab 533 may include a barbed tip 535. The suction conduit 530 may be attached to the non-orbiting scroll 572 by inserting the outlet portion 594 into a suction inlet 589 of the non-orbiting scroll 572. When the outlet portion 594 is inserted into the suction inlet 589, the tabs 533 may snap into engagement with the structure of the non-orbiting scroll 572 that defines the suction inlet 589. Once fully received into the suction inlet 589, the boss 531 and the barbed tips 535 may retain the suction conduit 530 relative to the non-orbiting scroll 572.

Figure 14:
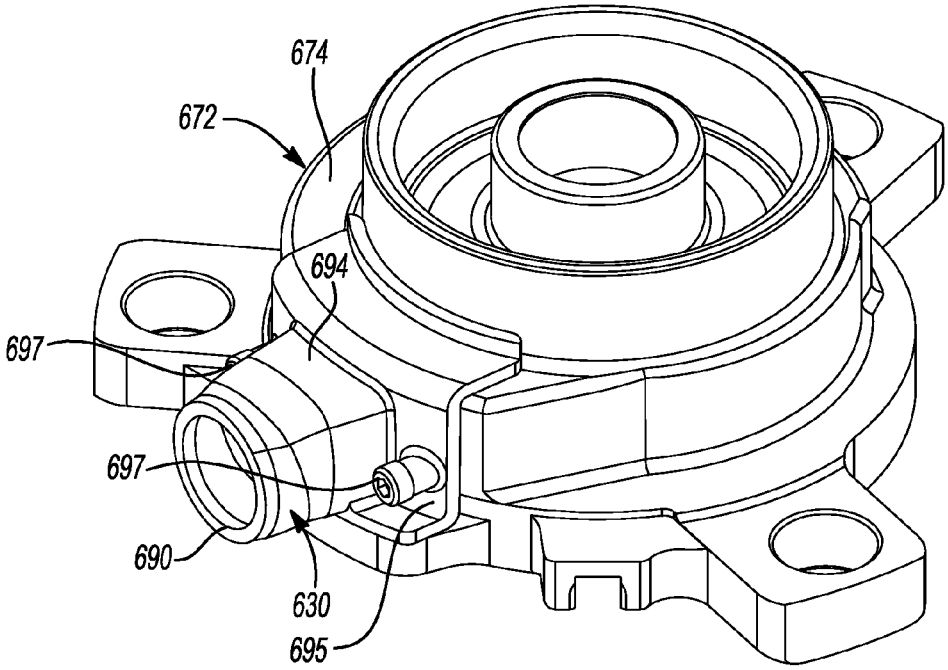
FIG. 14 is a perspective view of another non-orbiting scroll and another suction conduit according to the principles of the present disclosure.
Figure 15:
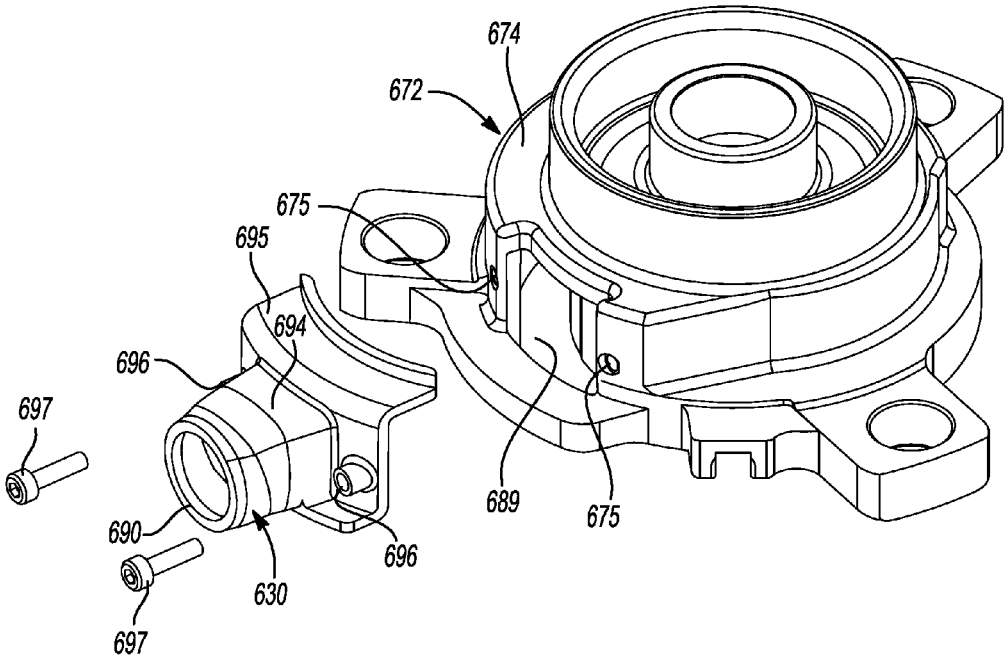
FIG. 15 is an exploded perspective view of the non-orbiting scroll and suction conduit of FIG. 14.

With reference to FIGS. 14 and 15, another non-orbiting scroll 672 and suction conduit 630 are provided. The structure and function of the non-orbiting scroll 672 and suction conduit 630 may be similar to that of any of the non-orbiting scrolls and suction conduits, respectively, described above. Therefore, similar components and features will not be described again in detail. It will be appreciated that the non-orbiting scroll 672 and suction conduit 630 could be incorporated into any of the compressors described above, for example.

The suction conduit 630 may be a generally tubular member having an inlet portion 690 and an outlet portion 694. A mounting flange 695 may extend outward from the outlet portion 694. The mounting flange 695 may include a shape that corresponds to a shape of an end plate 674 of the non-orbiting scroll 672. The mounting flange 695 may also include a plurality of apertures 696 on opposite sides of the outlet portion 694 that correspond to threaded apertures 675 in the non-orbiting scroll on opposite sides of a suction inlet 689 of the non-orbiting scroll 672. Fasteners 697 may extend through the apertures 696 and engage the threaded apertures 675 to secure the suction conduit 630 to the non-orbiting scroll 672.

Figure 16:
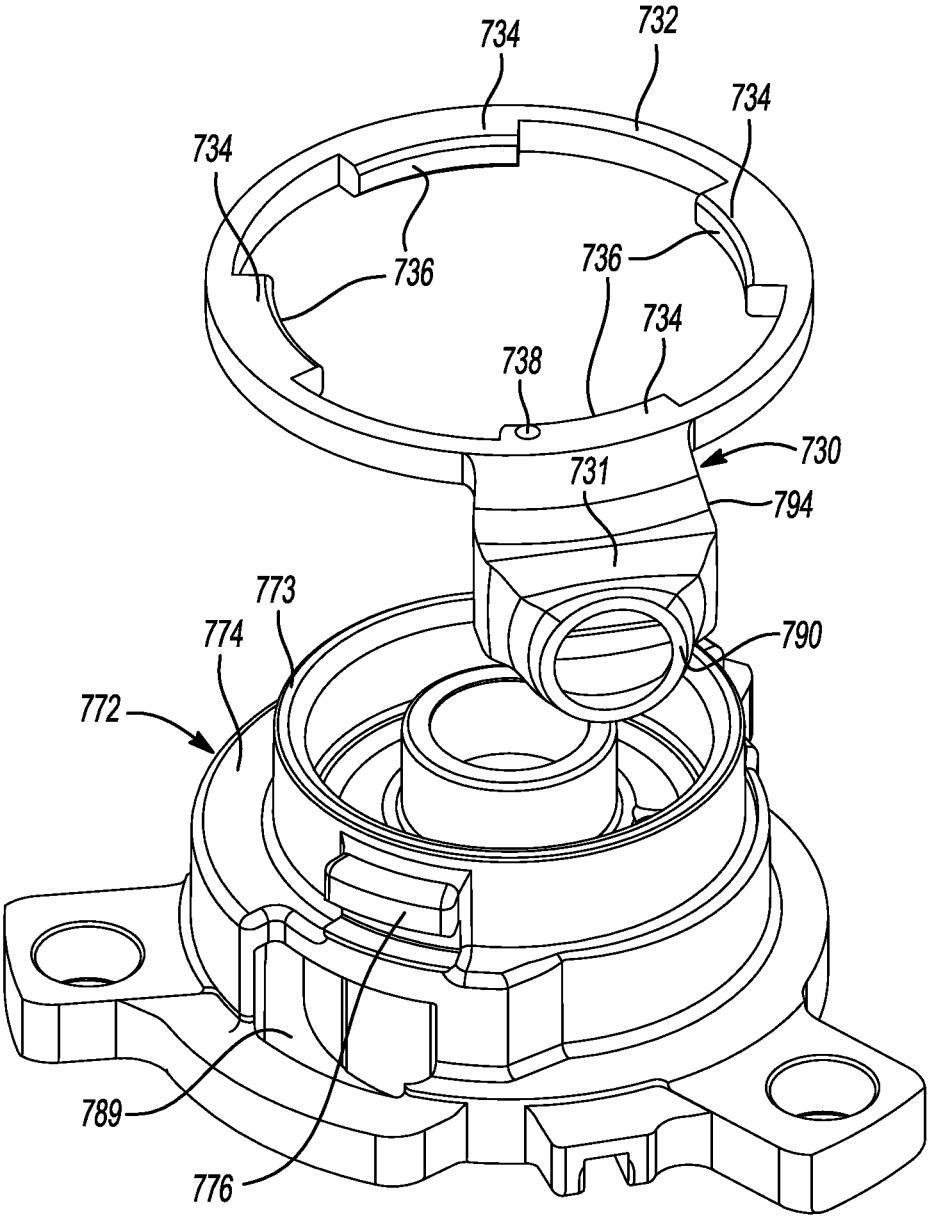
FIG. 16 is an exploded perspective view of another non-orbiting scroll and another suction conduit according to the principles of the present disclosure.
Figure 17:
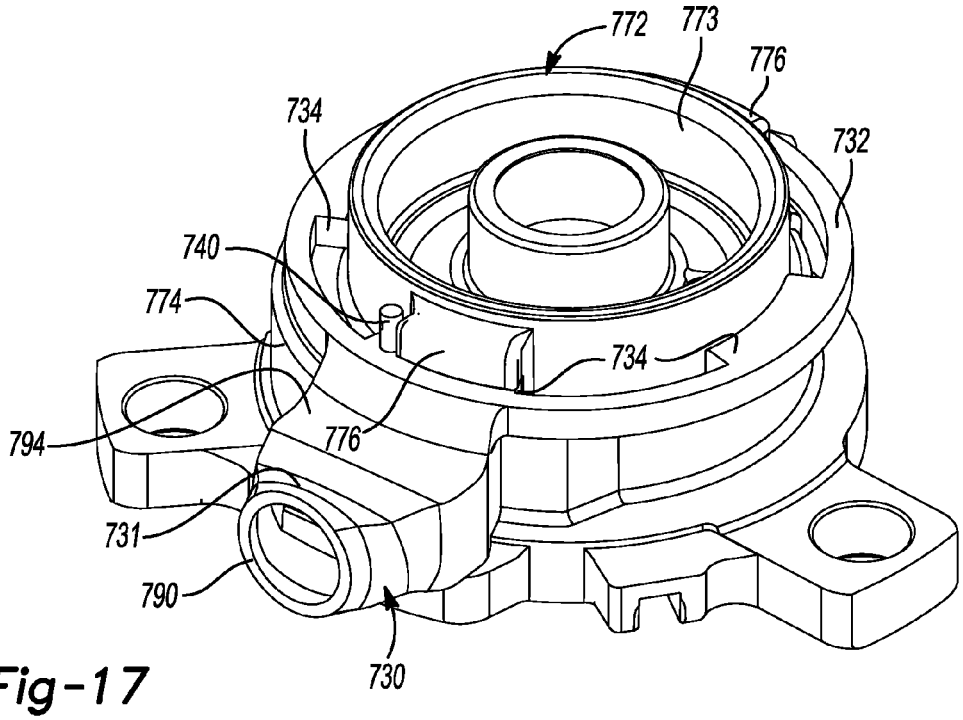
FIG. 17 is a perspective view of the non-orbiting scroll and suction conduit of FIG. 16.

With reference to FIGS. 16 and 17, another non-orbiting scroll 772 and suction conduit 730 are provided. The structure and function of the non-orbiting scroll 772 and suction conduit 730 may be similar to that of any of the non-orbiting scrolls and suction conduits, respectively, described above. Therefore, similar components and features will not be described again in detail. It will be appreciated that the non-orbiting scroll 772 and suction conduit 730 could be incorporated into any of the compressors described above, for example.

The non-orbiting scroll 772 may include an annular boss 773 extending upward from an end plate 774. Two or more blocks 776 may extend radially outward from the annular boss 773. In the particular example illustrated in the figures, two blocks 776 may be disposed about one-hundred-eighty degrees apart from each other.

The suction conduit 730 may include a generally tubular body 731 and a mounting ring 732. The body 731 may include an inlet portion 790 and an outlet portion 794. The mounting ring 732 may be integrally formed with or attached to the outlet portion 794. The mounting ring 732 may include a plurality of equally spaced tabs 734 extending radially inward therefrom. Inner surfaces 736 may be curved and may include a radius that is substantially equal to a radius of the annular boss 773. One of the tabs 734 may be generally angularly aligned with the outlet portion 794 and may include an aperture 738. In the particular example provided in the figures, the mounting ring 732 includes four tabs 734.

To mount the suction conduit 730 to the non-orbiting scroll 772, the mounting ring 732 may be slid onto the annular boss 773 and rotated relative to the annular boss 773 until the tabs 734 are underneath a corresponding one of the blocks 776. In some embodiments, the tabs 734 may be sized for a press fit of tabs 734 between the blocks 776 and the end plate 774. A dowel 740 may be pressed into the aperture 738 and may extend upward from the corresponding tab 734 to provide a positive stop that will abut the corresponding block 776 when the outlet portion 794 of the suction conduit 730 is aligned with a suction inlet 789 of the non-orbiting scroll 772.

Figure 18:
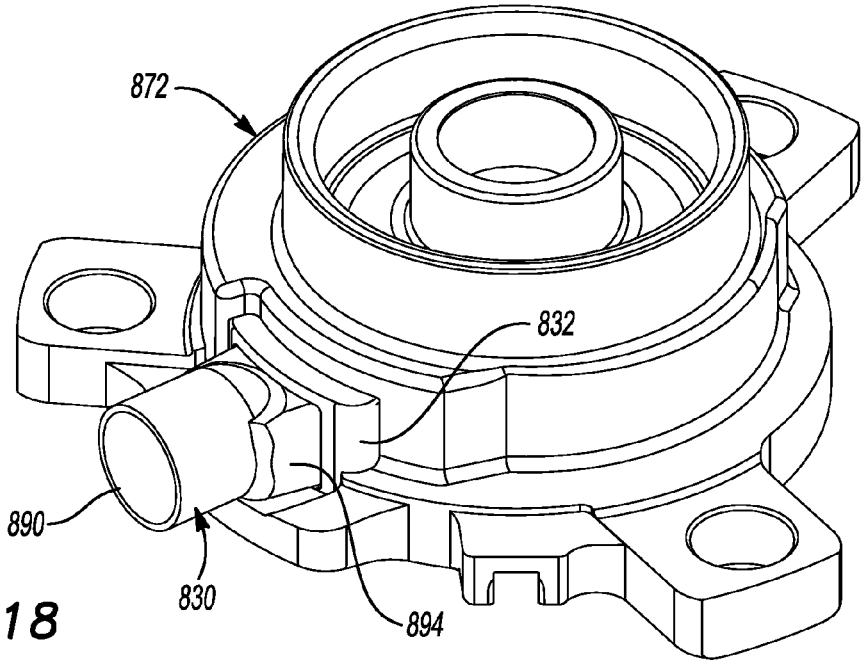
FIG. 18 is a perspective view of another non-orbiting scroll and another suction conduit according to the principles of the present disclosure.
Figure 19:
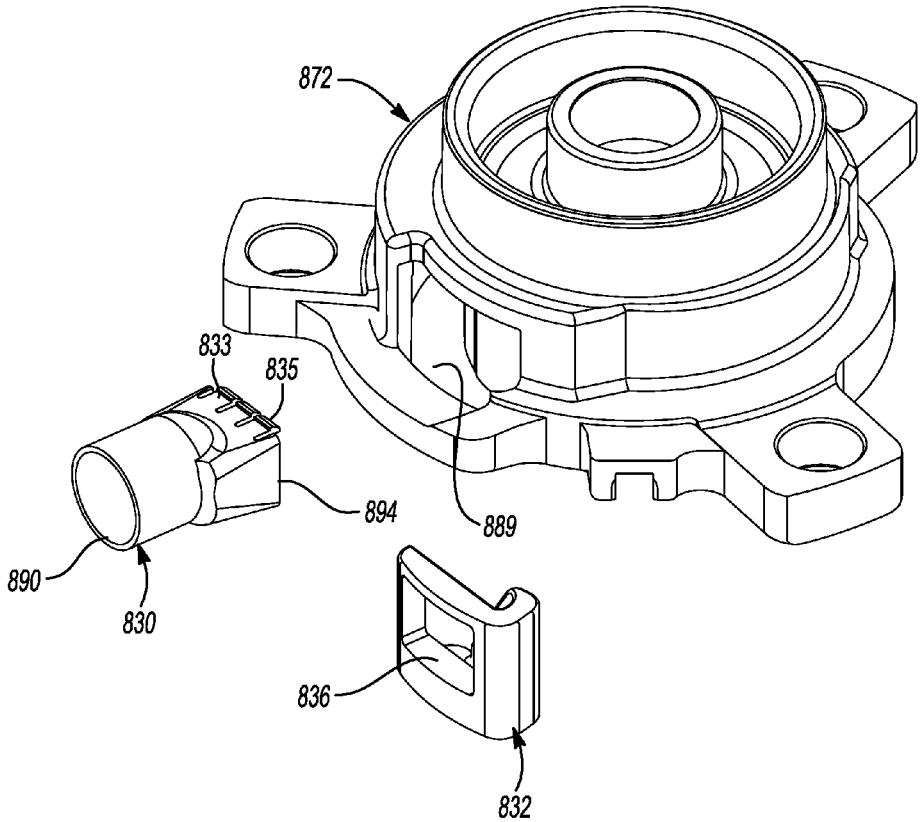
FIG. 19 is an exploded perspective view of the non-orbiting scroll and suction conduit of FIG. 18.

With reference to FIGS. 18 and 19, another non-orbiting scroll 872 and suction conduit 830 are provided. The structure and function of the non-orbiting scroll 872 and suction conduit 830 may be similar to that of any of the non-orbiting scrolls and suction conduits, respectively, described above. Therefore, similar components and features will not be described again in detail. It will be appreciated that the non-orbiting scroll 872 and suction conduit 830 could be incorporated into any of the compressors described above, for example.

The suction conduit 830 may be coupled to the non-orbiting scroll 872 by an adapter 832. The suction conduit 830 may include an inlet portion 890 and an outlet portion 894. The outlet portion 894 may include a resiliently flexible tab 833 having a barbed tip 835. In some embodiments, the outlet portion 894 may include a plurality of flexible tabs 833.

The adapter 832 may be a generally L-shaped member having a generally rectangular aperture 836. The adapter 832 may be slid into a suction inlet 889 of the non-orbiting scroll 872. The adapter 832 may be press fit into engagement with the suction inlet 889 or otherwise secured therein. In some embodiments, the adapter 832 may act as a seal between the non-orbiting scroll 872 and a corresponding orbiting scroll (not shown). The outlet portion 894 of the suction conduit 830 may be at least partially received into the aperture 836 and the one or more flexible tabs 833 may snap into engagement with the adapter 832 to retain the outlet portion 894 in the aperture 836. In this manner, the suction conduit 830 is in fluid communication with the suction inlet 889 through the aperture 836.

Figure 20:
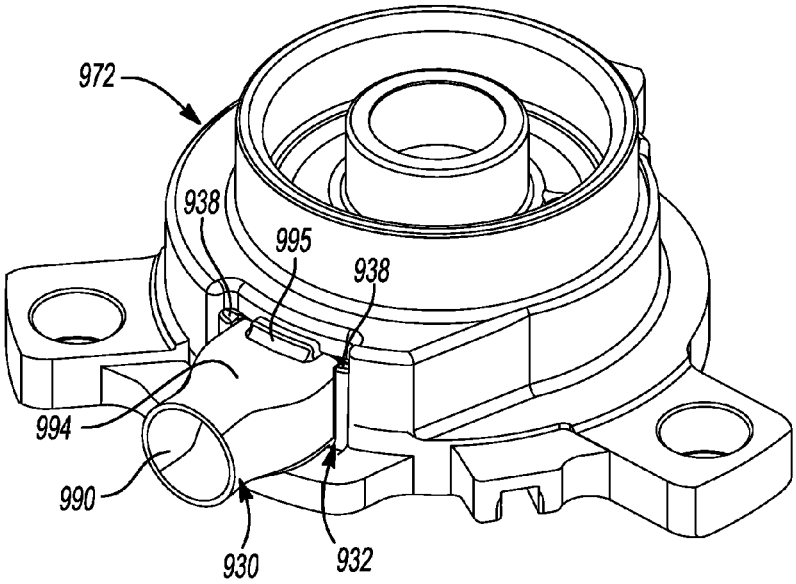
FIG. 20 is a perspective view of another non-orbiting scroll and another suction conduit according to the principles of the present disclosure.
Figure 21:
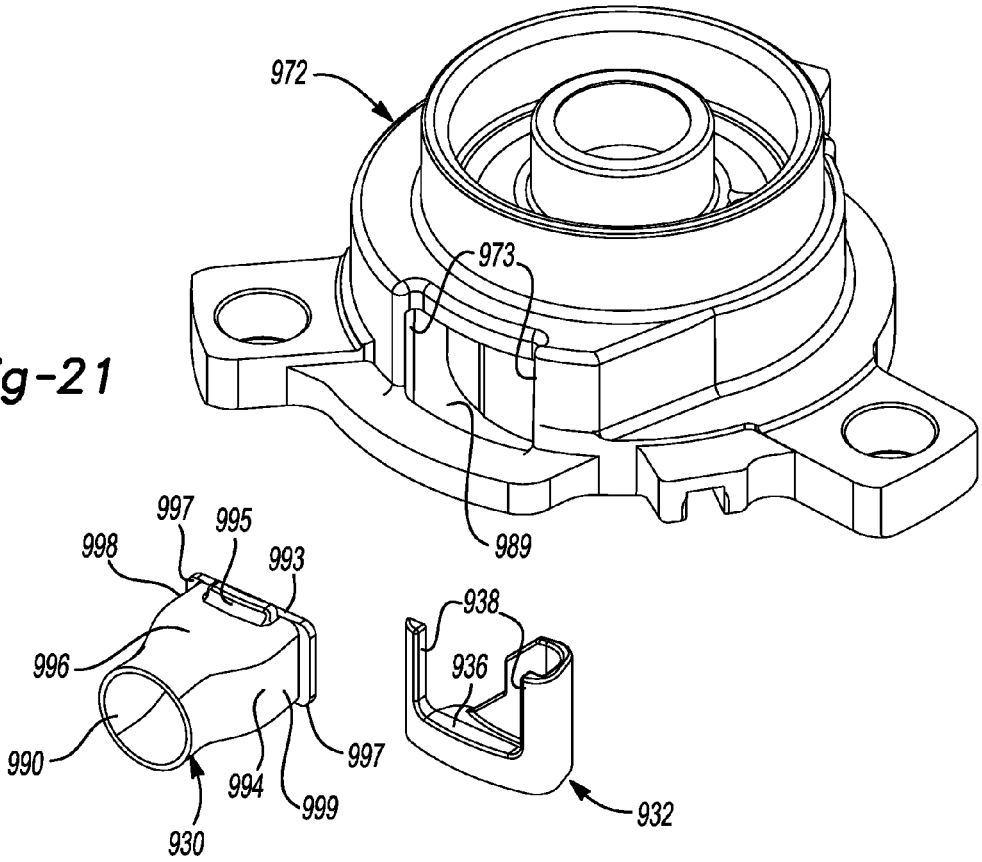
FIG. 21 is an exploded perspective view of the non-orbiting scroll and suction conduit of FIG. 20.

With reference to FIGS. 20 and 21, another non-orbiting scroll 972 and suction conduit 930 are provided. The structure and function of the non-orbiting scroll 972 and suction conduit 930 may be similar to that of any of the non-orbiting scrolls and suction conduits, respectively, described above. Therefore, similar components and features will not be described again in detail. It will be appreciated that the non-orbiting scroll 972 and suction conduit 930 could be incorporated into any of the compressors described above, for example.

The suction conduit 930 may be coupled to the non-orbiting scroll 972 by an adapter 932. The suction conduit 930 may include an inlet portion 990 and an outlet portion 994. The outlet portion 994 may include a boss 995 formed on a first surface 996 and relatively rigid tabs 997 extending laterally outward from second and third surfaces 998, 999. The first surface 996 may be substantially perpendicular to the second and third surfaces 998, 999. The boss 995 and tabs 997 may be disposed at or adjacent to a distal edge 993 of the outlet portion 994. The outlet portion 994 may be sized so that a horizontal dimension between outer edges of the tabs 997 is less than or nearly equal to a horizontal width of a suction inlet 989 of the non-orbiting scroll 972. As shown in FIG. 20, a vertical height of the outlet portion 994 may be sized so that the boss 995 cannot fit into the suction inlet 989 when the tabs 997 are received between vertically extending walls 973 defining the suction inlet 989.

The adapter 932 may be generally similar to the adapter 832 described above, except an aperture 936 of the adapter 932 may be generally U-shaped. The adapter 932 may be press fit into engagement with the suction inlet 989 and the outlet portion 994 to secure the suction conduit 930 to the non-orbiting scroll 972 and facilitate fluid communication between the suction conduit 930 and the suction inlet 989.

The suction conduit 930 can be mounted to the non-orbiting scroll 972 by first positing the outlet portion 994 such that the tabs 997 are received between the walls 973 defining the suction inlet 989. Next, the adapter 932 can be slid or pressed up into the suction inlet 989 such that arms 938 defining the aperture 936 engage the tabs 997 of the suction conduit 930.

Figure 22:
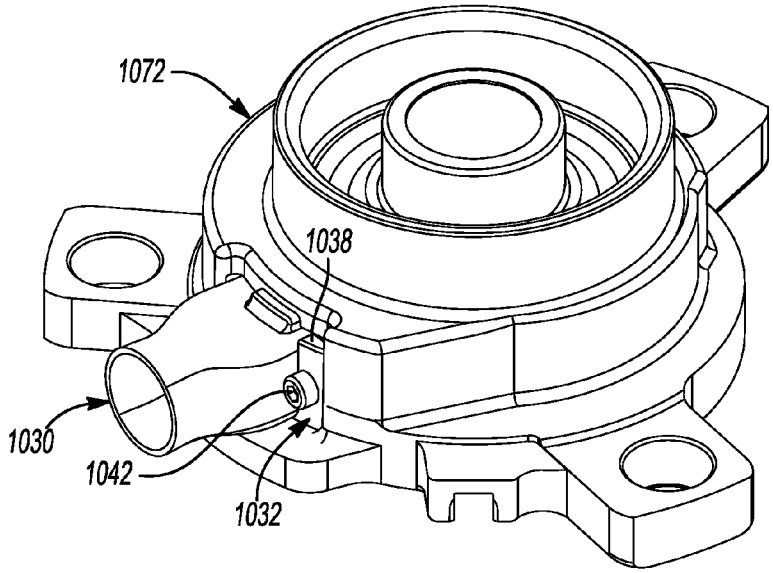
FIG. 22 is a perspective view of another non-orbiting scroll and another suction conduit according to the principles of the present disclosure.
Figure 23:
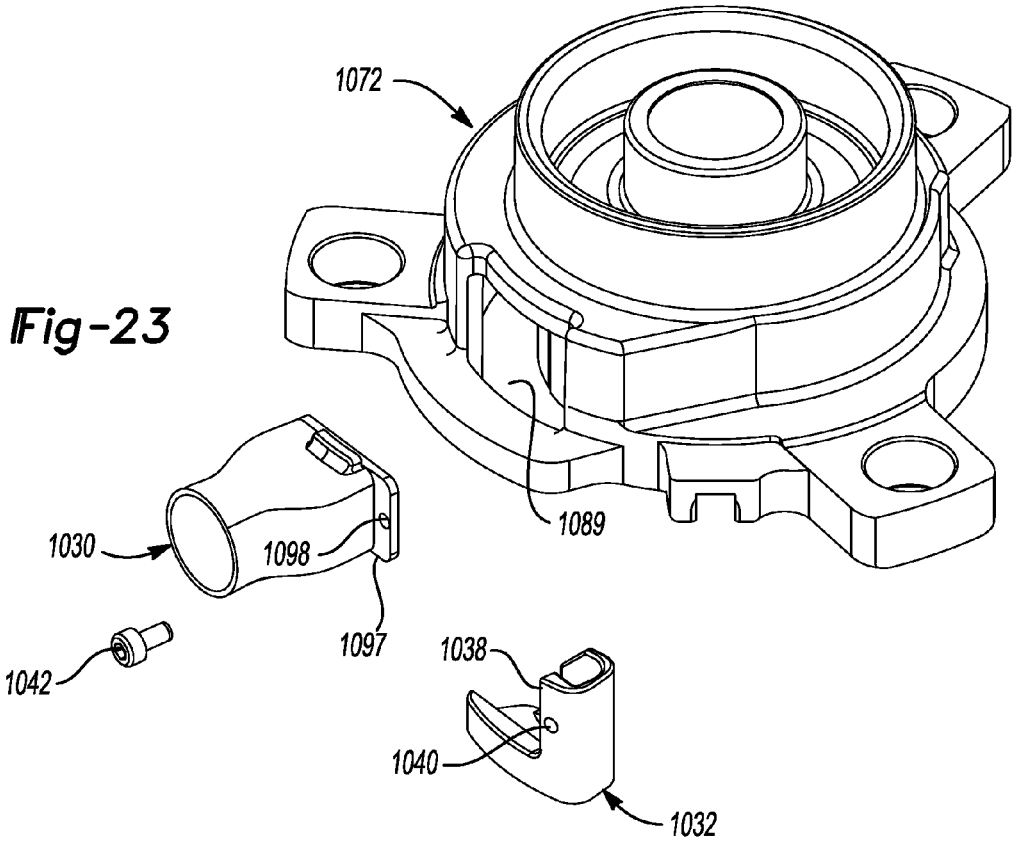
FIG. 23 is an exploded perspective view of the non-orbiting scroll and suction conduit of FIG. 22.
Figure 24:
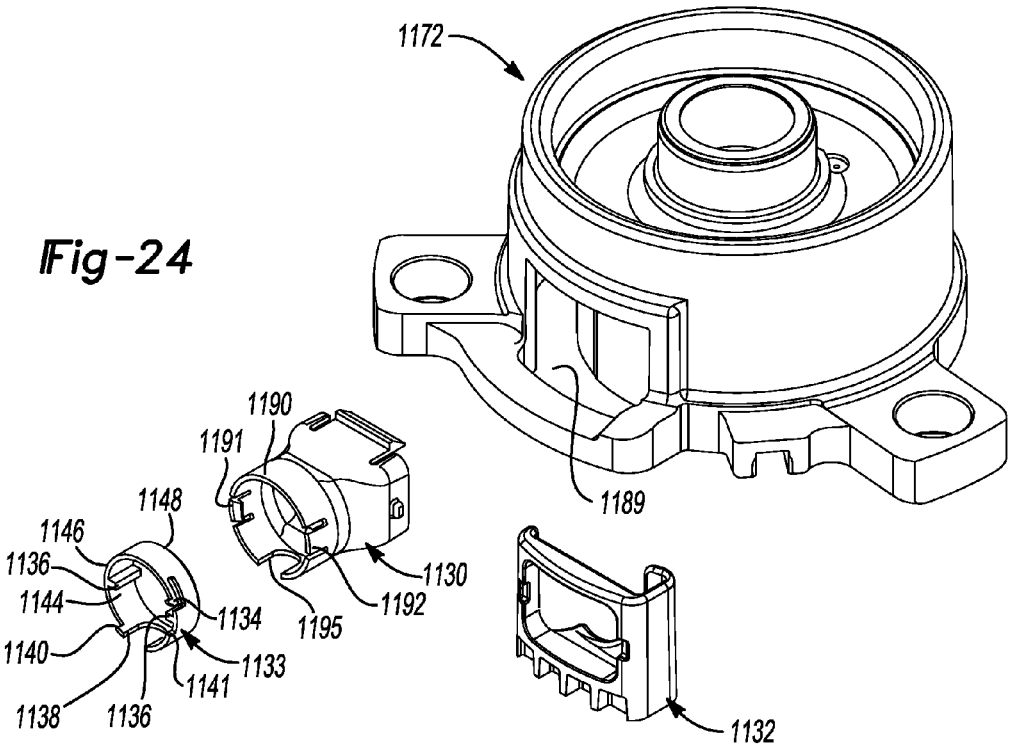
FIG. 24 is an exploded perspective view of another non-orbiting scroll and another suction conduit according to the principles of the present disclosure.
Figure 25:
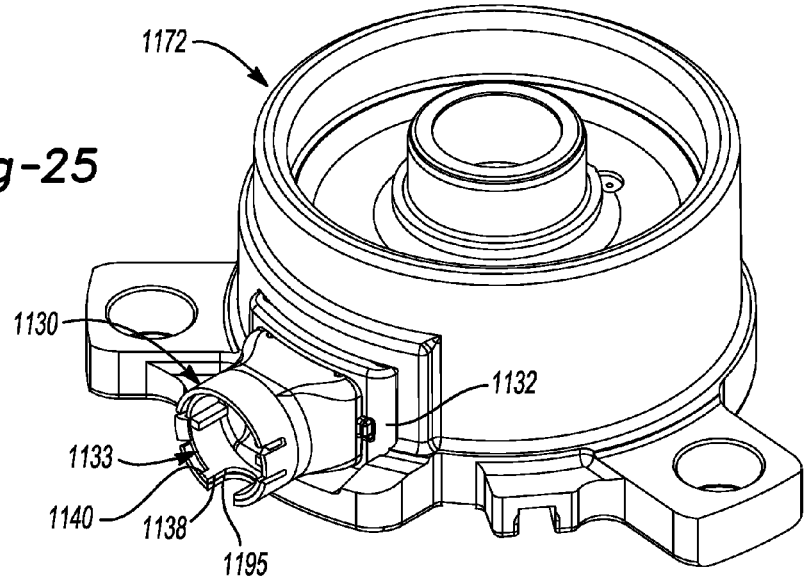
FIG. 25 is a perspective view of the non-orbiting scroll and suction conduit of FIG. 24.

With reference to FIGS. 22 and 23, another non-orbiting scroll 1072, suction conduit 1030 and adapter 1032 are provided. The structure and function of the non-orbiting scroll 1072, suction conduit 1030 and adapter 1032 may be similar to that of any of the orbiting scrolls, suction conduits and adapters, respectively, described above. Therefore, similar components and features will not be described again in detail. It will be appreciated that the non-orbiting scroll 1072, suction conduit 1030 and adapter 1032 could be incorporated into any of the compressors described above, for example.

The suction conduit 1030 may be substantially similar to the suction conduit 930 described above, except the suction conduit 1030 may include a single tab 1097 having an aperture 1098 extending therethrough. The adapter 1032 may be substantially similar to the adapter 932, except the adapter 1032 may include a single arm 1038 having an aperture 1040 that corresponds to the aperture 1098 in the suction conduit 1030. Like the adapter 932, the adapter 1032 may be slid or pressed into a suction inlet 1089 of the non-orbiting scroll 1072. As shown in FIG. 22, a fastener 1042 may threadably engage the aperture 1040 and/or the aperture 1098 to secure the suction conduit 1030 relative to the adapter 1032 and the non-orbiting scroll 1072.

With reference to FIGS. 24-30, another non-orbiting scroll 1172, suction conduit 1130 and adapter 1132 are provided. The structure and function of the non-orbiting scroll 1172, suction conduit 1130 and adapter 1132 may be similar to that of any of the non-orbiting scrolls, suction conduits and adapters, respectively, described above. Therefore, similar components and features will not be described again in detail. The non-orbiting scroll 1172, suction conduit 1130 and adapter 1132 could be incorporated into a compressor 1110, which may be similar to any of the compressors described above.

Figure 28:
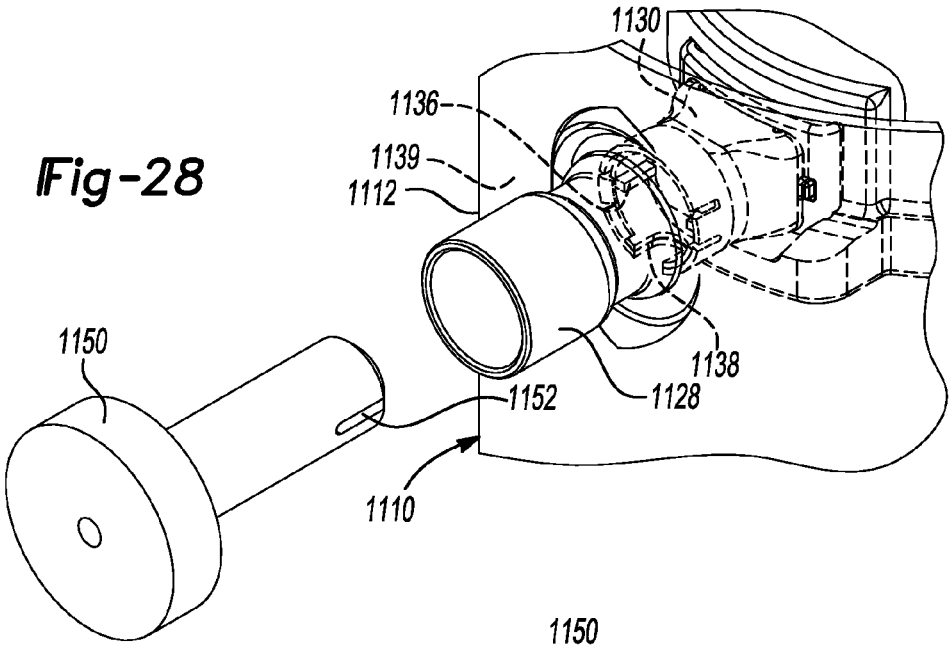
FIG. 28 is a partial perspective view of an oil-charging nozzle and a compressor having the non-orbiting scroll and suction conduit of FIG. 24.
Figure 29:
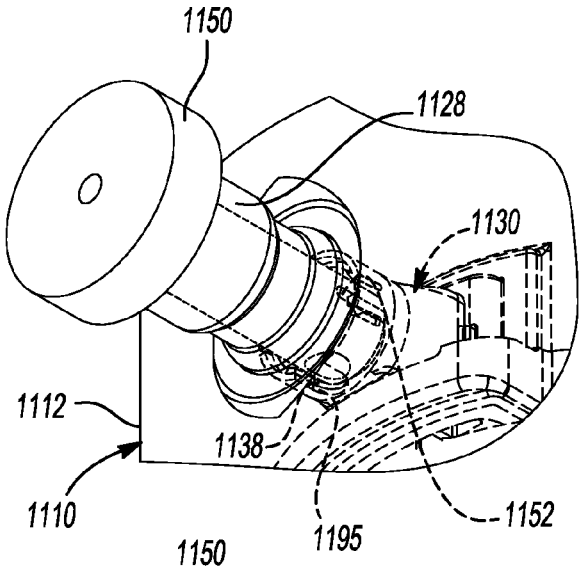
FIG. 29 is a partial perspective view of the oil-charging nozzle received in the suction conduit with a sleeve of the suction conduit in a first position.
Figure 30:
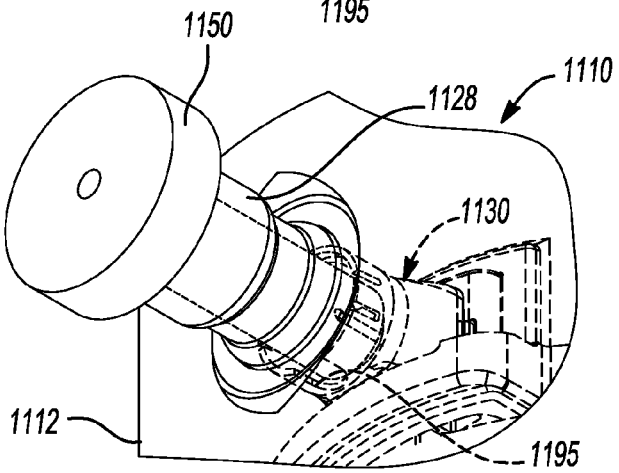
FIG. 30 is a partial perspective view of the oil-charging nozzle received in the suction conduit with the sleeve of the suction conduit in a second position.

In a similar manner as described above, the adapter 1132 may slide or be pressed into a suction inlet 1189, and the suction conduit 1130 may snap into engagement with the adapter 1132 to provide fluid communication between the suction conduit 1130 and the suction inlet 1189. An inlet portion 1190 of the suction conduit 1130 may include first and second resiliently flexible tabs 1191, 1192 having inwardly extending barbs 1193. The inlet portion 1190 may also include a generally U-shaped cutout 1195. As shown in FIGS. 28-30, the inlet portion 1190 may be axially aligned with a suction fitting 1128 mounted to a shell assembly 1112 of the compressor 1110.

A sleeve 1133 may be received within the inlet portion 1190 and may be rotatable therein relative to the suction conduit 1130 between an oil-charging position (shown in FIGS. 25 and 29) and a sealed position (shown in FIGS. 26, 27 and 30), as will be subsequently described. The sleeve 1133 may be a generally tubular member including a resiliently flexible tab 1134, a pair of rails 1136, a generally U-shaped cutout 1138, and first and second stops 1140, 1141. The tab 1134 may include a barb 1142 that extends outward in a direction generally parallel to a longitudinal axis of the sleeve 1133. The rails 1136 may extend radially inward from an inner diametrical surface 1144 of the sleeve 1133 and may extend between first and second axial ends 1146, 1148 of the sleeve 1133. The stops 1140, 1141 may be disposed adjacent to and on opposite sides of the cutout 1138 and may extend axially outward from the first end 1146.

During assembly of the compressor 1110, the sleeve 1133 may be initially mounted to the suction conduit 1130 and positioned in the oil-charging position (FIG. 25) such that the cutout 1138 of the sleeve 1133 is aligned with the cutout 1195 in the suction conduit 1130. After assembly of the compressor 1110 and with the sleeve 1133 in the oil-charging position, an oil-charging nozzle 1150 (shown schematically in FIGS. 28-30) may be inserted through the suction fitting 1128 and into the inlet portion 1190 of the suction conduit 1130. The oil-charging nozzle 1150 (which may be in fluid communication with a source of oil) may include a pair of slots 1152 that may slidably receive the rails 1136 of the sleeve 1133.

Once the oil-charging nozzle 1150 is received in the suction conduit 1130, oil may be delivered into the suction conduit 1130 through the oil-charging nozzle 1150. Some of the oil that is discharged from the oil-charging nozzle 1150 may flow through the suction conduit 1130 and into the suction inlet 1189, and most of the oil discharged from the oil-charging nozzle 1150 may flow through the cutouts 1138, 1195 of the sleeve 1133 and suction conduit 1130, respectively. The oil that flows through the cutouts 1138, 1195 may drain into a suction-pressure chamber 1139 of the compressor 1110 to lubricate moving components of the compressor 1110 and/or accumulate in an oil sump (not shown) of the compressor 1110.

Figure 26:
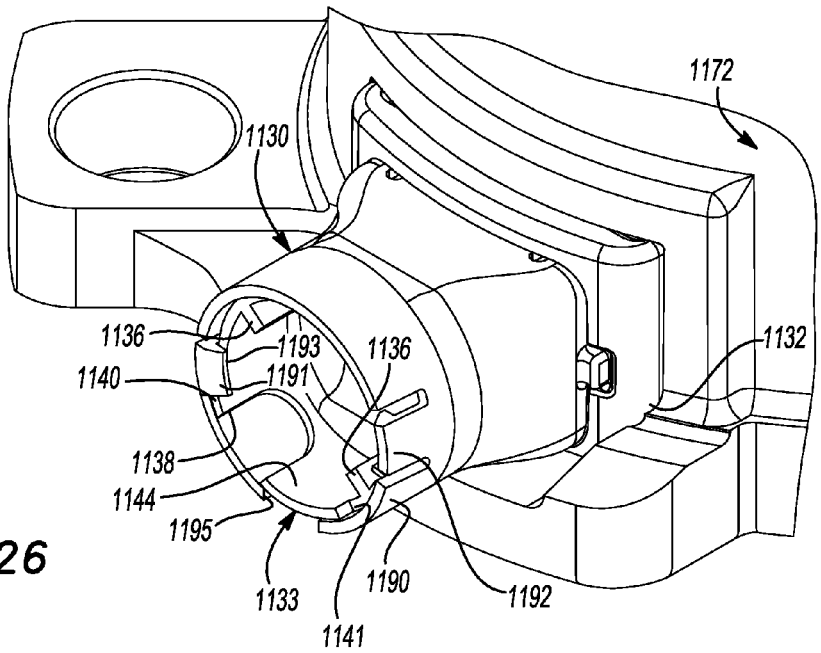
FIG. 26 is a partial perspective view of the non-orbiting scroll and suction conduit of FIG. 24.
Figure 27:
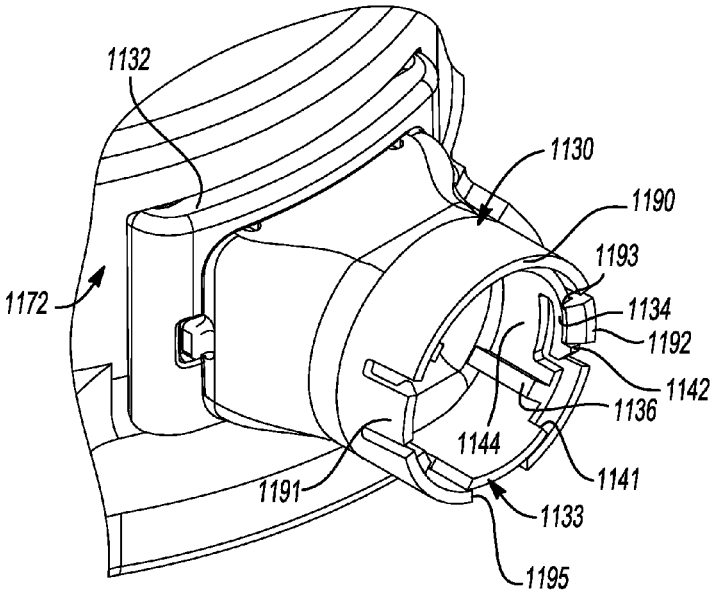
FIG. 27 is another partial perspective view of the non-orbiting scroll and suction conduit of FIG. 24.

After the oil is discharged, the oil-charging nozzle 1150 can be rotated in a clockwise direction, which causes corresponding rotation of the sleeve 1133 relative to the suction conduit 1130 toward the sealed position (FIGS. 26, 27 and 30). As the sleeve 1133 rotates toward the sealed position, the barb 1142 of the tab 1134 of the sleeve 1133 comes into contact with the barb 1193 of the second tab 1192, thereby causing the tab 1134 to flex inward. Once the sleeve 1133 is rotated into the sealed position, the barb 1142 may be clear of the barb 1193 (as shown in FIG. 27), which allows the tabs 1134 to flex back to its normal position. In this manner, interference between the barbs 1142, 1193 may restrict or prevent the sleeve 1133 from rotating in a counterclockwise direction out of the sealed position. Interference between the first stop 1140 and the first tab 1191 may limit a range of motion of the sleeve 1133 in the clockwise direction. As shown in FIGS. 26 and 27, when the sleeve is in the sealed position, the cutouts 1138, 1195 are misaligned with each other, thereby sealing the cutout 1195 to restrict or prevent fluid-flow through the cutout 1195.

While the sleeve 1133 and suction conduit 1130 are described above as being configured for the sleeve 113 to be rotated relative to the suction conduit 1130 to align the cutouts 1138, 1195 of the sleeve 1133 and suction conduit 1130, respectively, alternatively, the sleeve 1133 could be configured so that insertion of the oil nozzle 1150 into the sleeve 1133 causes the sleeve 1133 to move axially inward (i.e., toward the non-orbiting scroll 1172) relative to the suction conduit 1130 to align the cutouts 1138, 1195 with each other. In such embodiments, a spring (not shown) may bias the sleeve 1133 axially outward (i.e., away from the non-orbiting scroll 1172) to misalign the cutouts 1138, 1195 with each other when the oil nozzle 1150 is removed from the sleeve 1133.

Figure 31:
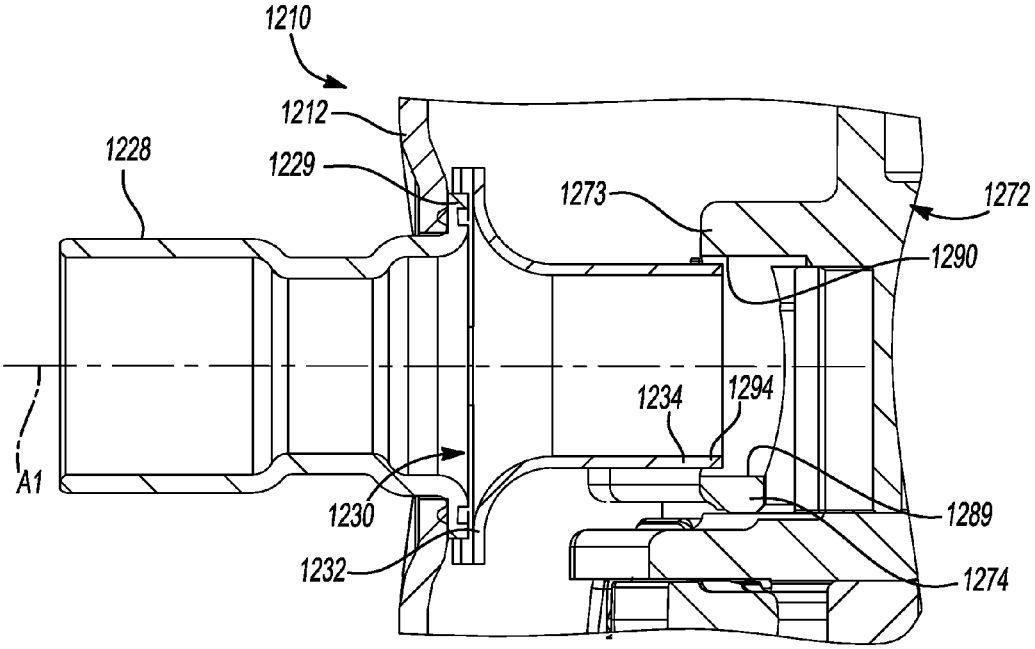
FIG. 31 is a partial cross-sectional view of another compressor having another suction conduit according to the principles of the present disclosure.
Figure 32:
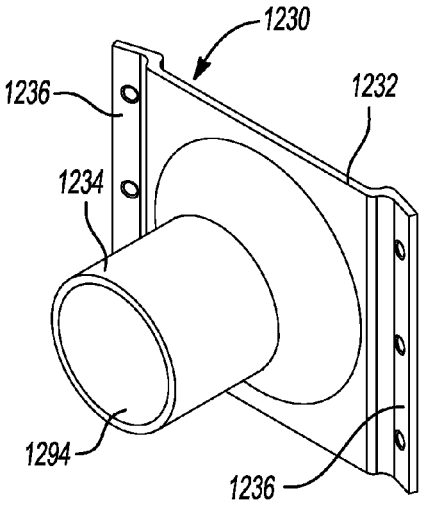
FIG. 32 is a perspective view of the suction conduit of FIG. 31.
Figure 33:
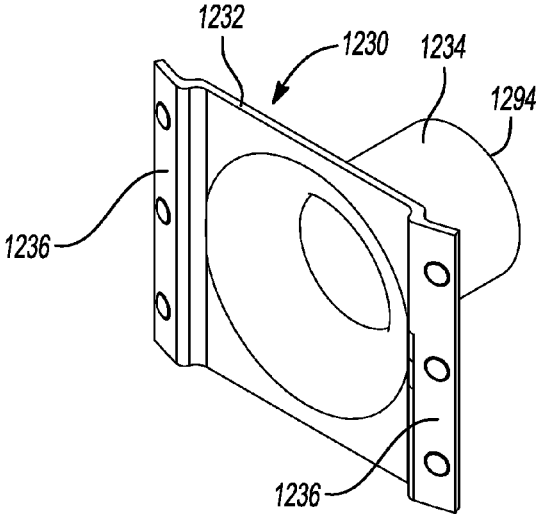
FIG. 33 is another perspective view of the suction conduit of FIG. 31.

With reference to FIGS. 31-33, another compressor 1210 is provided that may include shell assembly 1212, a non-orbiting scroll 1272, a suction fitting 1228 and a suction conduit 1230. The structure and function of the shell assembly 1212, non-orbiting scroll 1272, and suction fitting 1228 may be similar to that of any of the shell assemblies, non-orbiting scrolls, and suction fittings, respectively, described above. Therefore, similar components and features will not be described again in detail.

The suction conduit 1230 may include a mounting flange 1232 integrally formed with a tubular body 1234. The mounting flange 1232 may include a pair of legs 1236 that may be welded or otherwise attached to the shell assembly 1212 in a position such that the body 1234 is substantially axially aligned with the suction fitting 1228. Additionally or alternatively, the legs 1236 could be welded or otherwise attached to a flange portion 1229 of the suction fitting 1228.

An outlet portion 1294 of the body 1234 may extend into or near a suction inlet 1289 of the non-orbiting scroll 1272. As shown in FIG. 31, gaps 1290 may separate the outlet portion 1294 and walls 1273, 1274 that define the suction inlet 1289. The gaps 1290 allow for manufacturing and assembly tolerances and axial movement of the non-orbiting scroll 1272 relative to the shell assembly 1212 during operation of the compressor 1210. In some embodiments, the suction conduit 1230 may be generally tangent to the spiral wrap of the non-orbiting scroll 1272. In some embodiments, a longitudinal axis or centerline of the suction conduit 1230 may intersect the spiral wrap of the non-orbiting scroll 1272.

Figure 34:
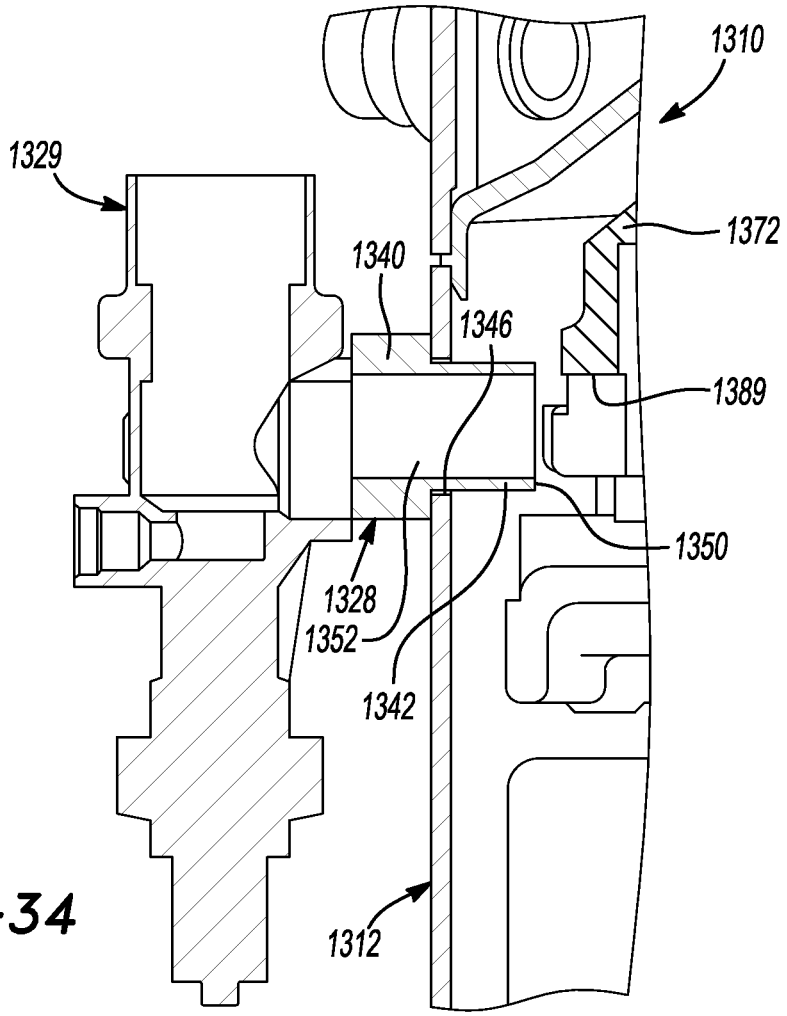
FIG. 34 is a partial cross-sectional view of another compressor having a suction fitting according to the principles of the present disclosure.
Figure 35:
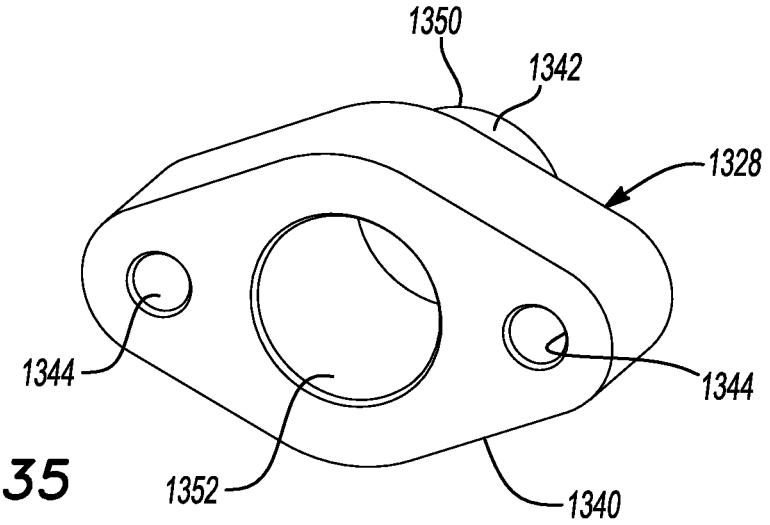
FIG. 35 is a perspective view of the suction fitting of FIG. 34.
Figure 36:
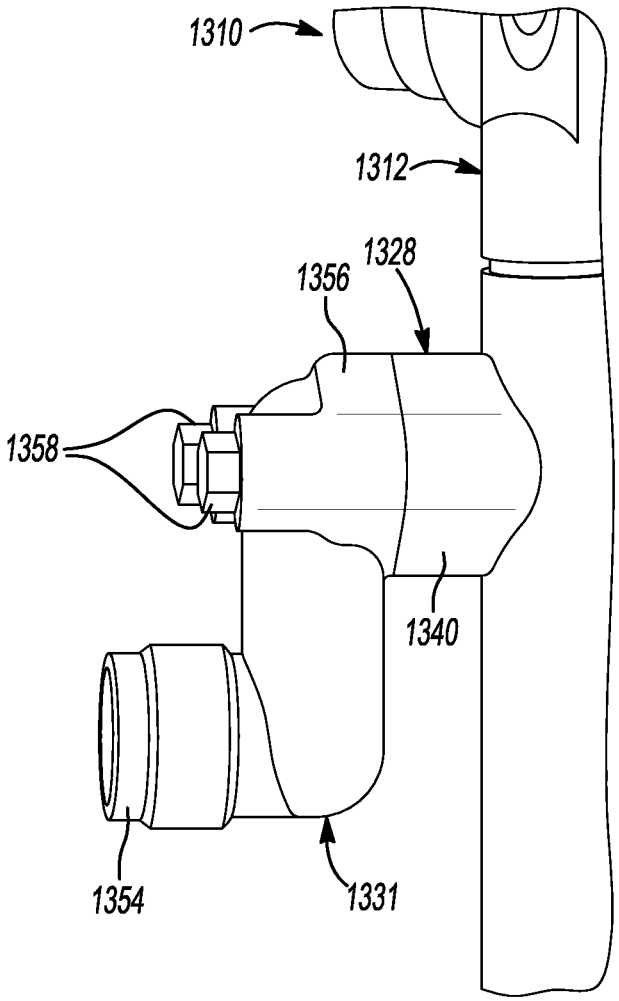
FIG. 36 is a partial perspective view of the compressor of FIG. 34.

With reference to FIGS. 34-36, another compressor 1310 is provided that may include shell assembly 1312, a non-orbiting scroll 1372 and a suction fitting 1328. The structure and function of the shell assembly 1312 and non-orbiting scroll 1372 may be similar to that of any of the shell assemblies and non-orbiting scrolls, respectively, described above. Therefore, similar components and features will not be described again in detail.

The suction fitting 1328 may include a flange portion 1340 and a tubular portion 1342. The flange portion 1340 may include a pair of mounting apertures 1344 extending therethrough. The tubular portion 1342 may extend through an opening 1346 in the shell assembly 1312, and the flange portion 1340 may be welded, bolted or otherwise attached to an outer surface 1348 of the shell assembly 1312. The tubular portion 1342 may be generally aligned with and may extend toward a suction inlet 1389 of the non-orbiting scroll 1372. A distal end 1350 of the tubular portion 1342 may be spaced apart from an opening of the suction inlet 1389 by a relatively small amount. In the particular example illustrated in FIG. 34, the distance between the opening of the suction inlet 1389 and the distal end 1350 of the tubular portion 1342 may be about three millimeters. A suction aperture 1352 may extend through the flange portion 1340 and the tubular portion 1342 and may provide fluid communication between the adaptor fitting 1329 and the suction inlet 1389. While not shown in the figures, the flange portion 1340 may also include an additional aperture in communication with the suction aperture 1352 that allows for connection of a temperature or pressure sensor, for example, to monitor temperature or pressure of suction-pressure working fluid in the suction aperture 1352.

As shown in FIG. 34, an adaptor fitting 1329 may be mounted to the flange portion 1340 and may be in fluid communication with the suction aperture 1352. The adaptor fitting 1329 could include a valve for controlling a flow of working fluid into the suction aperture 1352. The adaptor fitting 1329 may be in fluid communication with a suction line (not shown) that may transmit fluid from a heat exchanger (e.g., an evaporator) to the compressor 1310. It will be appreciated that the suction line could be connected directly to the flange portion 1340 of the suction fitting 1328 or connected to the flange portion 1340 with a gasket (not shown) therebetween.

As shown in FIG. 36, another adaptor fitting 1331 is provided that may be attachable to the suction fitting 1328 instead of the adaptor fitting 1329. The adaptor fitting 1331 may be a generally L-shaped tube including an inlet portion 1354 and an outlet portion 1356. Fasteners 1358 may extend through the outlet portion 1356 and engage the mounting apertures 1344 to couple the adaptor fitting 1331 to the flange portion 1340 for fluid communication with the suction aperture 1352. Connecting the adaptor fitting 1331 to the suction fitting 1328 lowers a position at which the suction line connects to the compressor 1310.

With reference to FIGS. 37-40, another compressor 1410 is provided that may include shell assembly 1412, a non-orbiting scroll 1472, a suction fitting 1428 and an adapter 1430. The structure and function of the shell assembly 1412 and non-orbiting scroll 1472 may be similar to that of any of the shell assemblies and non-orbiting scrolls, respectively, described above. Therefore, similar components and features will not be described again in detail.

The suction fitting 1428 may be an elongated tubular member having an inlet portion 1432 and an outlet portion 1434. The suction fitting 1428 may extend through an opening in the shell assembly 1412 and may be directly or indirectly attached to the shell assembly 1412 by welding and/or any other attachment means.

The adaptor 1430 may bolted or otherwise attached to the non-orbiting scroll 1472 such that a passageway 1436 extending through the adaptor 1430 is in fluid communication with a suction inlet 1489 of the non-orbiting scroll 1472. The outlet portion 1434 of the suction fitting 1428 may be received in the passageway 1436. The outlet portion 1434 and the passageway 1436 may be sized and positioned so that a gap exists between an outer surface of the outlet portion 1434 and a surface 1440 defining an inlet 1442 of the passageway 1436.

Figure 37:
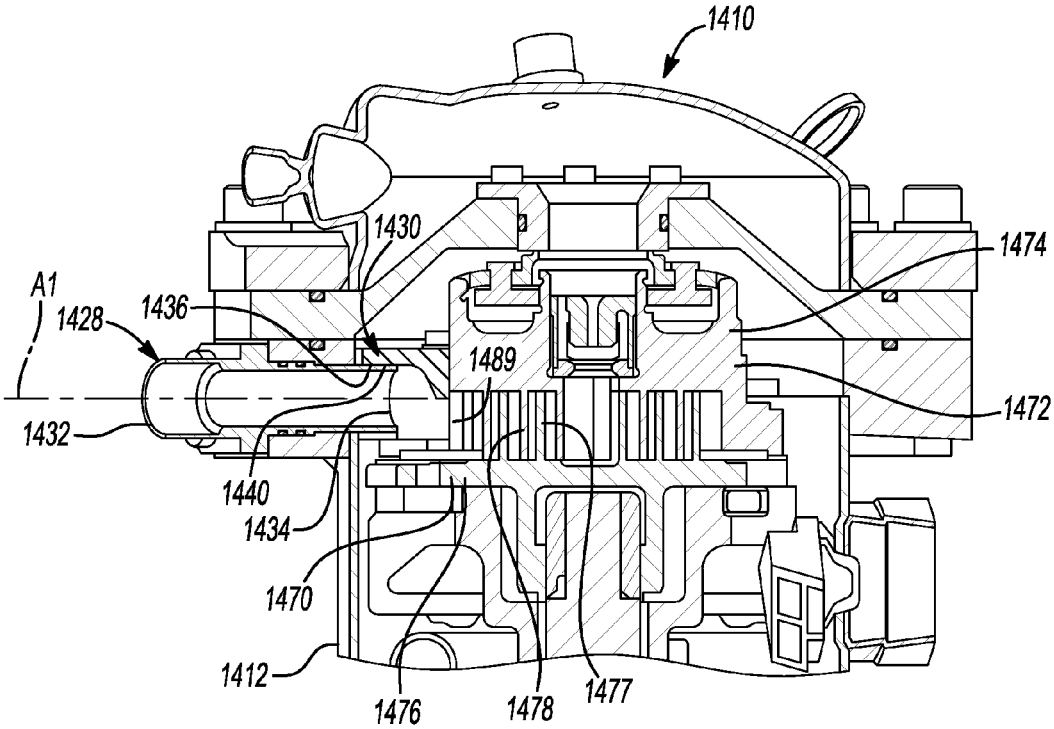
FIG. 37 is a partial cross-sectional view of another compressor having another suction conduit according to the principles of the present disclosure.
Figure 38:
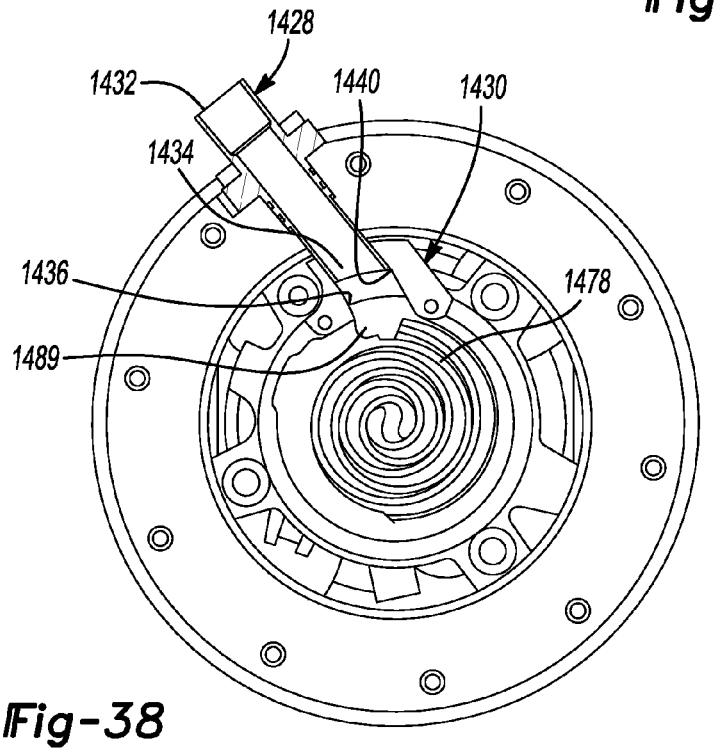
FIG. 38 is another cross-sectional view of the compressor of FIG. 37.
Figure 39:
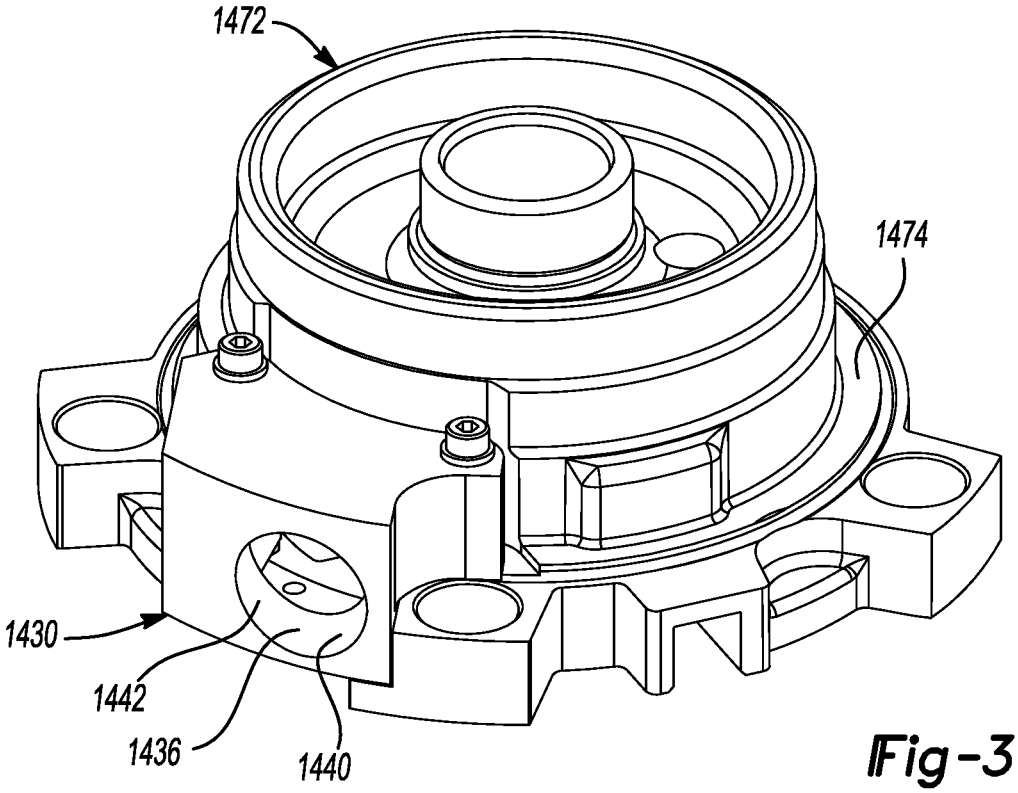
FIG. 39 is a perspective view of a non-orbiting scroll and the suction conduit of the compressor of FIG. 37.
Figure 40:
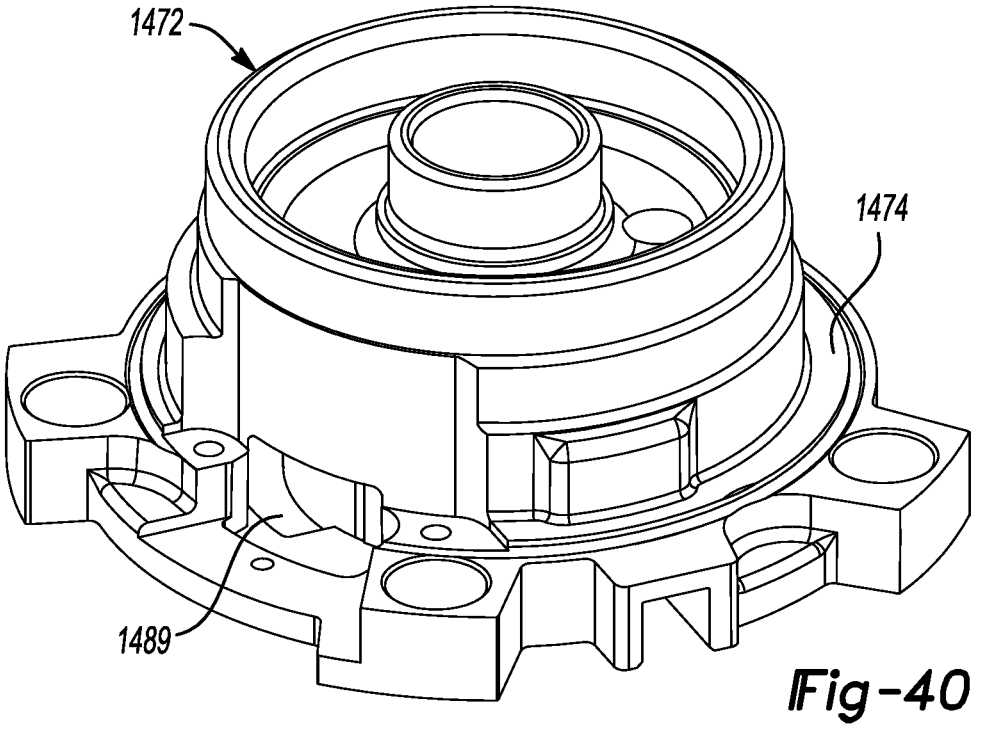
FIG. 40 is a perspective view of the non-orbiting scroll of FIG. 39.

As shown in FIG. 37, the suction fitting 1428 may be positioned relative to the non-orbiting scroll 1472 such that a centerline or longitudinal axis A1 of the suction fitting 1428 is positioned vertically between an end plate 1474 of the non-orbiting scroll 1472 and an end plate 1476 of an orbiting scroll 1470 (i.e., the longitudinal axis may be positioned so that it intersects the spiral wraps 1478, 1477 of the scrolls 1472, 1470). As shown in FIG. 38, the suction fitting 1428 could be positioned such that the longitudinal axis of the suction fitting 1428 does not intersect an axis about which the orbiting scroll 1470 orbits. In some embodiments, the longitudinal axis of the suction fitting 1428 may be tangential or nearly tangential to an outermost portion of a spiral wrap 1478 of the non-orbiting scroll 1472.

Figure 41:
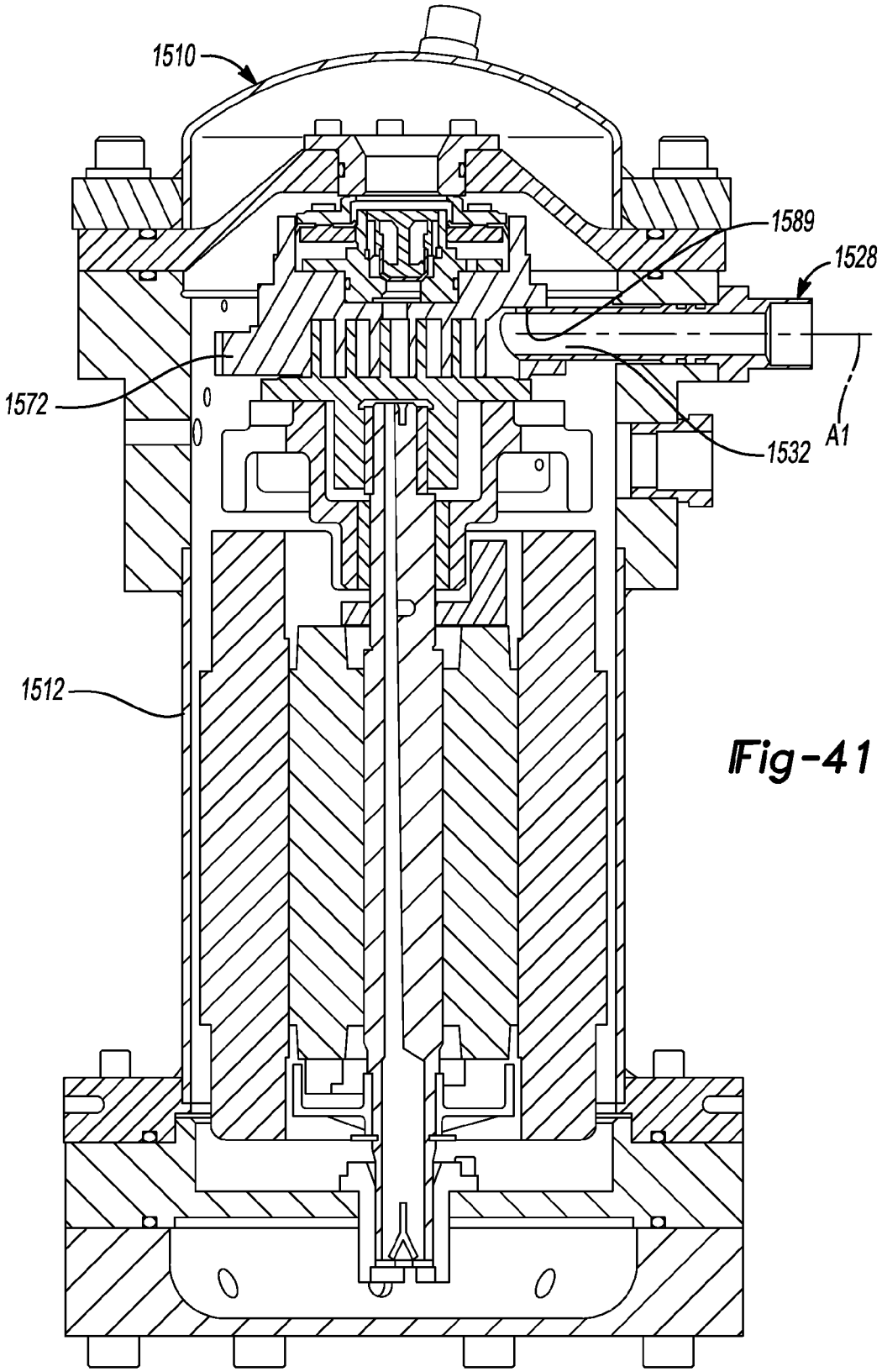
FIG. 41 is a cross-sectional view of another compressor having another suction conduit according to the principles of the present disclosure.
Figure 42:
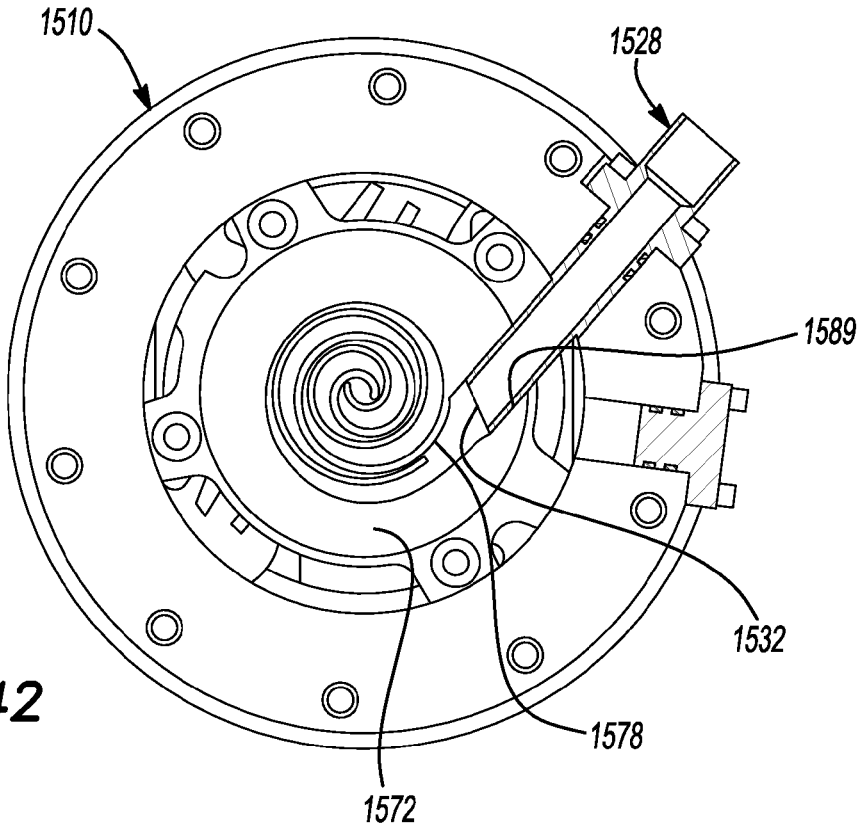
FIG. 42 is a cross-sectional view of the compressor of FIG. 41.

With reference to FIGS. 41 and 42, another compressor 1510 is provided that may include shell assembly 1512, a non-orbiting scroll 1572, a suction fitting 1528. The structure and function of the shell assembly 1512 and non-orbiting scroll 1572 and suction fitting 1528 may be substantially similar to that of the shell assembly 1412 and non-orbiting scroll 1472 and suction fitting 1428, respectively. Therefore, similar components and features will not be described again in detail.

As shown in FIGS. 41 and 42, the compressor 1510 may not include an adaptor like the adapter 1430. That is, the suction fitting 1528 may extend directly into a suction inlet 1589 of the non-orbiting scroll 1572. In a similar manner as described above, an outlet portion 1532 of the suction fitting 1528 may be spaced apart from walls of the non-orbiting scroll 1572 that define the suction inlet 1589 to allow for manufacturing and assembly tolerances and relative movement between the non-orbiting scroll 1572 and the shell assembly 1512. As shown in FIG. 42, the suction fitting 1528 may be tangential or nearly tangential to a spiral wrap 1578 of the non-orbiting scroll 1572.

Figure 43:
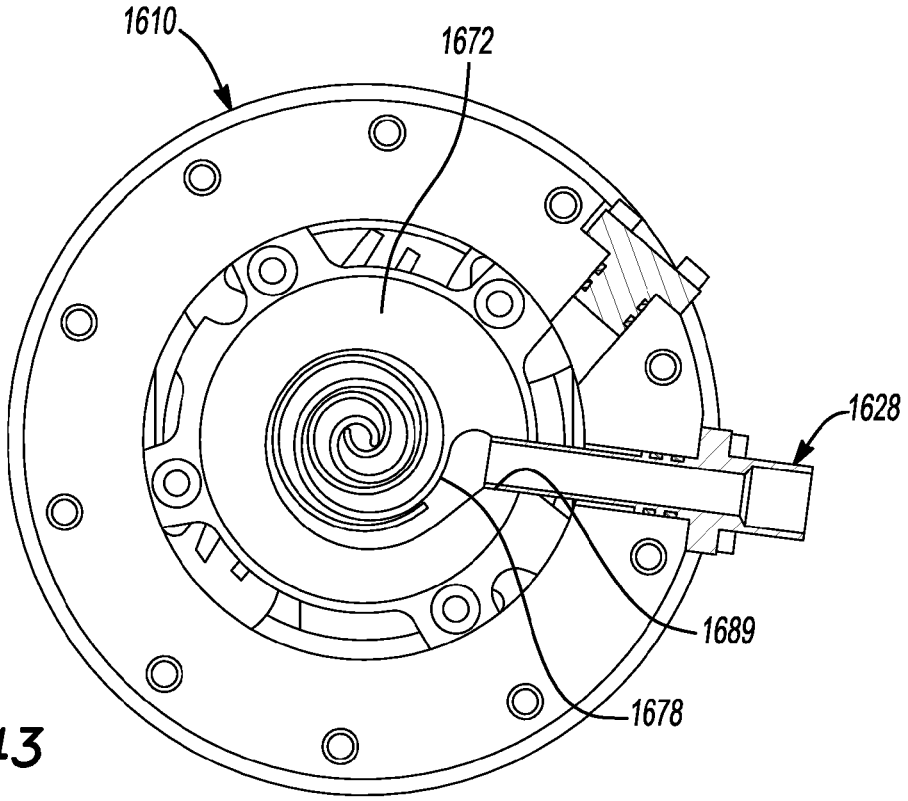
FIG. 43 is a cross-sectional view of another compressor having another suction conduit according to the principles of the present disclosure.

With reference to FIG. 43, another compressor 1610 is provided that may include a suction fitting 1628. The structure and function of the compressor 1610 and suction fitting 1628 may be substantially similar to that of the compressor 1510 and suction fitting 1528. Therefore, similar components and features will not be described again in detail. Unlike the suction fitting 1528, however, the suction fitting 1628 may be positioned relative to a suction inlet 1689 of a non-orbiting scroll 1672 such that a longitudinal axis of the suction fitting 1628 extends radially outward from the suction inlet 1689 rather than tangential to a spiral wrap 1678.

Figure 44:
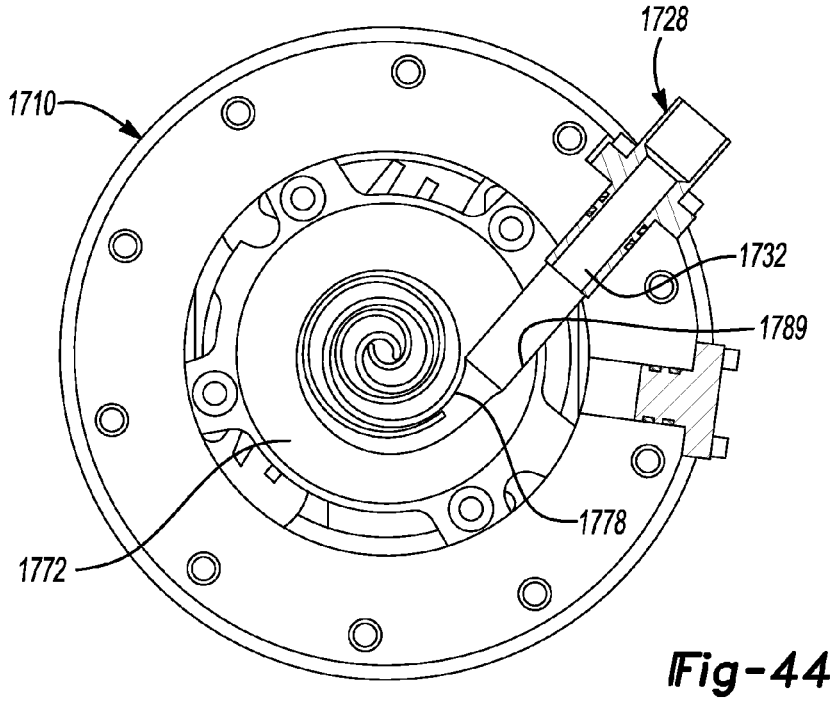
FIG. 44 is a cross-sectional view of another compressor having another suction conduit according to the principles of the present disclosure.

With reference to FIG. 44, another compressor 1710 is provided that may include a suction fitting 1728. The structure and function of the compressor 1710 and suction fitting 1728 may be substantially similar to that of the compressor 1510 and suction fitting 1528. Therefore, similar components and features will not be described again in detail. Unlike the suction fitting 1528, however, the suction fitting 1728 may be sized and positioned so that an outlet 1732 of the suction fitting 1728 is spaced apart from and not received within a suction inlet 1789 of a non-orbiting scroll 1772. It will be appreciated that the suction fitting 1728 could include any length shorter or longer than the lengths shown in FIGS. 42-44. Furthermore, while the suction fitting 1728 is shown as being generally tangential to a spiral wrap 1778 of the non-orbiting scroll 1772, in some embodiments, the suction fitting 1728 could extend radially outward.

Figure 45:
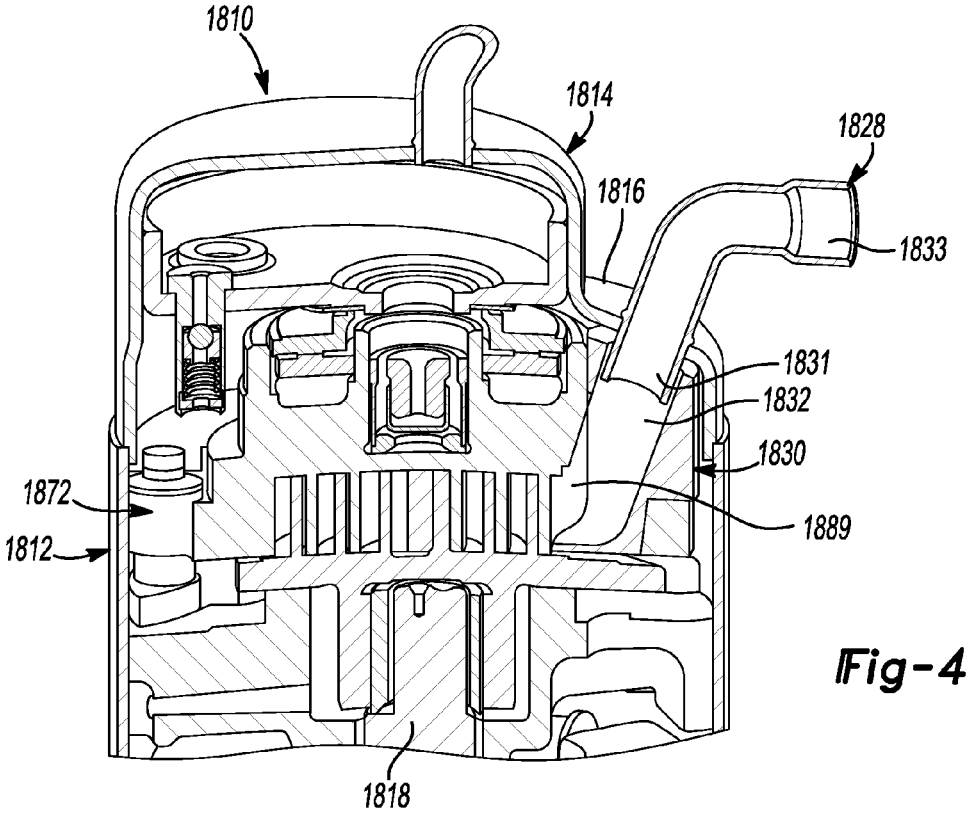
FIG. 45 is a partial cross-sectional view of another compressor having another suction conduit according to the principles of the present disclosure.

With reference to FIG. 45, another compressor 1810 is provided that may include a shell assembly 1812, a non-orbiting scroll 1872, a suction fitting 1828 and an adapter 1830. The structure and function of the shell assembly 1812, non-orbiting scroll 1872, suction fitting 1828 and adaptor 1830 may be generally similar to that of the shell assembly 1412, non-orbiting scroll 1472, suction fitting 1428 and adaptor 1430, respectively, apart from any differences described below and/or shown in figures. Therefore, similar components and features will not be described again in detail.

The shell assembly 1812 may include an end cap 1814 having a step portion 1816. The step portion 1816 may be disposed vertically above the adaptor 1830 and may include an opening through which the suction fitting 1828 may extend. The adaptor 1830 may include a passageway 1832 that is angled relative to a longitudinal axis of a crankshaft 1818 of the compressor 1810. The suction fitting 1828 may include an outlet portion 1831 that is received in the passageway 1832 and spaced apart from a suction inlet 1889 of the non-orbiting scroll 1872. An inlet portion 1833 of the suction fitting 1828 may be angled relative to the outlet portion 1831 and may extend generally horizontally.

Figure 46:
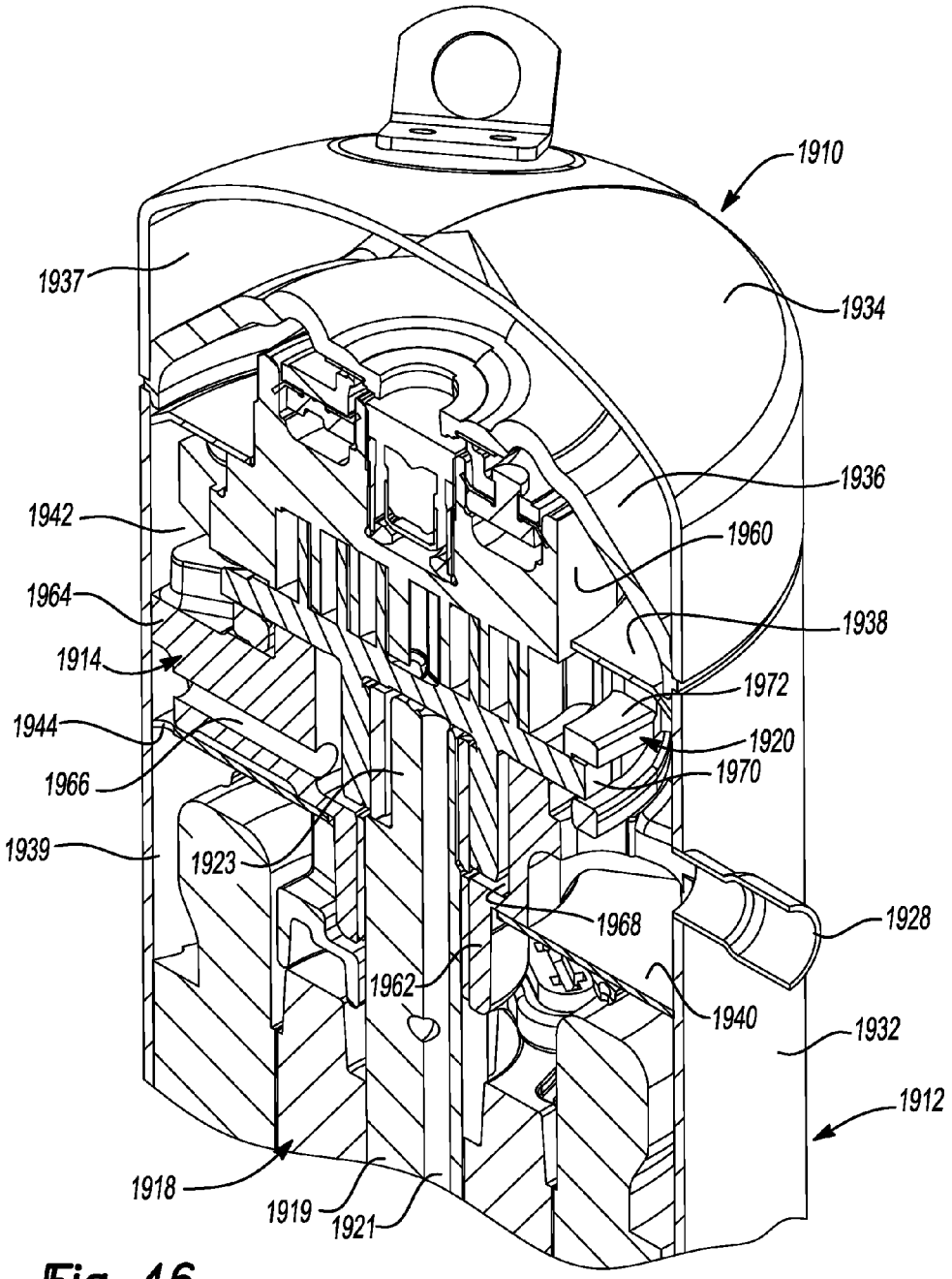
FIG. 46 is a cross-sectioned perspective view of another compressor according to the principles of the present disclosure.

With reference to FIG. 46, a compressor 1910 is provided and may include a shell assembly 1912, a bearing housing 1914, a motor assembly 1918, a compression mechanism 1920, a suction fitting 1928, a partition 1936, an upper barrier 1938 and a lower barrier 1940. The structure and function of the shell assembly 1912, bearing housing 1914, motor assembly 1918, compression mechanism 1920, suction fitting 1928, and partition 1936 may be similar to that of the shell assembly 12, first bearing housing assembly 14, motor assembly 18, compression mechanism 20, suction fitting 28, and partition 36, respectively, apart from any differences described below and/or shown in the figures. Therefore, similar components and features will not be described again in detail.

Briefly, the shell assembly 1912 may include a cylindrical shell 1932 and an upper end cap 1934. The end cap 1934 and the partition 1936 may cooperate to form a discharge-pressure chamber 1937 therebetween that receives discharge-pressure working fluid from the compression mechanism 1920. The partition 1936 and the shell 1932 may cooperate to form a suction-pressure chamber 1939 that receives suction-pressure working fluid from the suction fitting 1928. The compression mechanism 1920, bearing housing 1914, motor assembly 1918, and upper and lower barriers 1938, 1940 may be disposed within the suction-pressure chamber 1939.

The upper barrier 1938 may be disposed proximate to and spaced apart from the partition 1936. In the particular example illustrated in FIG. 46, the upper barrier 1938 may be an annular member extending around a hub 1960 of a non-orbiting scroll 1972. The upper barrier 1938 may be welded, brazed or otherwise attached to the shell 1932, the non-orbiting scroll 1972 or the partition 1936.

The lower barrier 1940 may be an annular member extending around a bearing hub 1962 of the bearing housing 1914. The lower barrier 1940 may be disposed between radially extending arms 1964 of the bearing housing 1914 and the motor assembly 1918. The lower barrier 1940 may be welded, brazed or otherwise attached to the shell 1932. In this manner, the lower barrier 1940 and the upper barrier 1938 may cooperate to form an isolation chamber 1942 therebetween. The lower barrier 1940 may include one or more apertures 1944 extending therethrough to allow a limited amount of fluid-flow into and out of the isolation chamber 1942. One or more of the radially extending arms 1964 of the bearing housing 1914 may include a radially extending passageway 1966 in fluid communication with a recess 1968 of the bearing housing 1914 and the one or more apertures 1944.

During operation of the compressor 1910, the suction-pressure working fluid may be drawn in the isolation chamber 1942 through the suction fitting 1928. The upper and lower barriers 1938, 1940 may isolate the suction-pressure working fluid from the partition 1936 and the motor assembly 1918 to minimize or reduce an amount of heat absorbed by the suction-pressure working fluid received from the suction fitting 1928 prior to being drawn in the compression mechanism 1920.

While a crankshaft 1919 driven by the motor assembly 1918 is rotating, oil may be pumped up through an oil passageway 1921 in the crankshaft 1919 from an oil sump (not shown) to the orbiting scroll 1970 and eccentric pin 1923 of the crankshaft 1919. Some of this oil may drain down from the eccentric pin 1923 into the recess 1968 of the bearing housing 1914 and into the radially extending passageway 1966. From the passageway 1966, oil may drain out of the isolation chamber 1942 through the aperture 1944 and fall onto the motor assembly 1918 to cool and lubricate the motor assembly 1918 and other moving parts.

With reference to FIGS. 47-52, another compressor 2010 is provided that may include a shell assembly 2012, a non-orbiting scroll 2072, a suction fitting 2028 and a suction conduit 2030. The structure and function of the shell assembly 2012, non-orbiting scroll 2072, suction fitting 2028 and suction conduit 2030 may be generally similar to that of the shell assembly 12, non-orbiting scroll 72, suction fitting 28 and suction conduit 30, respectively, apart from any differences described below and/or shown in figures. Therefore, similar components and features will not be described again in detail.

The suction conduit 2030 may include a first portion 2031 and a second portion 2034. The first portion 2031 and the second portion 2034 may be injection molded or otherwise formed from a polymeric or metallic material. The first portion 2031 and the second portion 2034 may be joined together by welding and/or any other attachment means to form a working fluid passageway therebetween.

The first portion 2031 may include a body portion 2050 and a rim portion 2051 surrounding the body portion 2050 and extending therefrom. The body portion 2050 may be a generally rectangular member and may include an inlet opening 2096 extending therethrough at or proximate a lower edge 2033 of the body portion 2050. The inlet opening 2096 may be generally axially aligned with the suction fitting 2028 and may receive working fluid from the suction fitting 2028.

Figure 47:
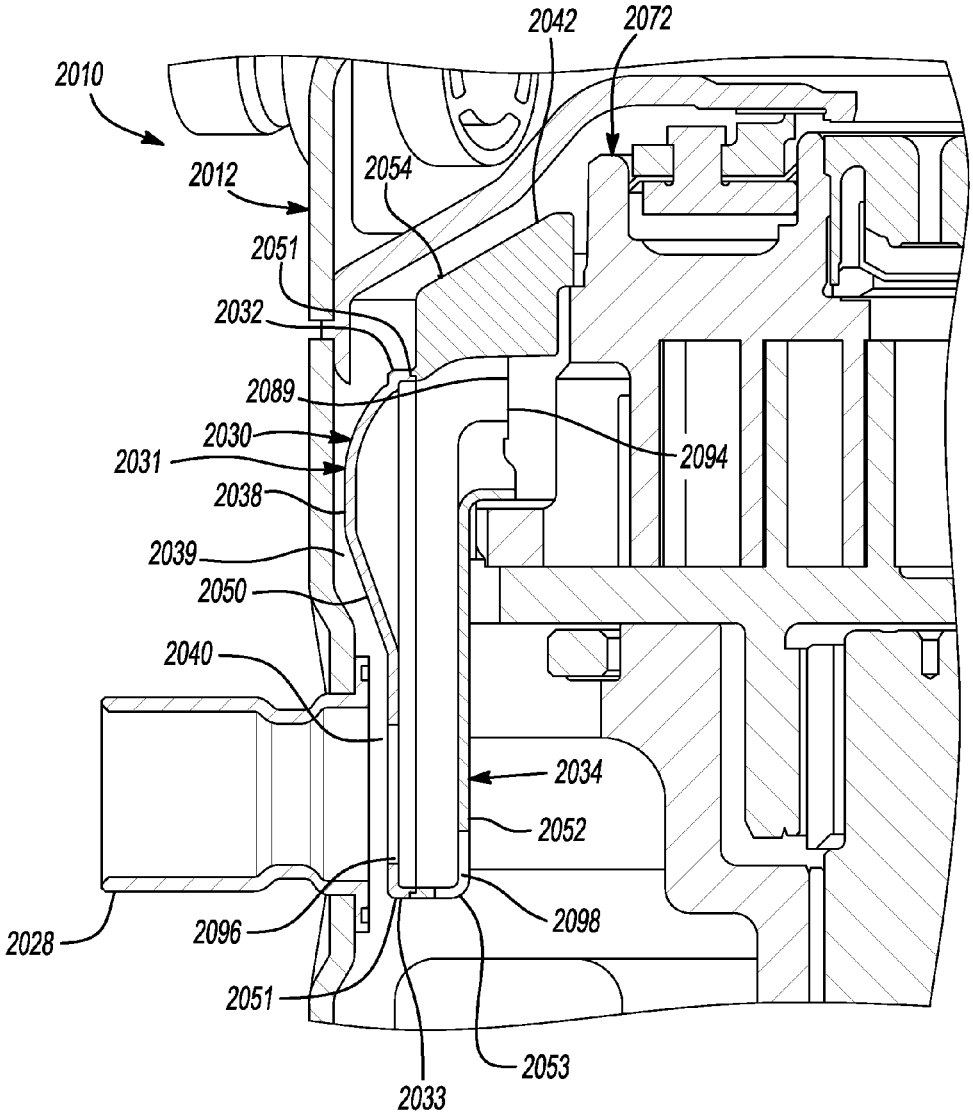
FIG. 47 is a partial cross-sectional view of another compressor having another suction conduit according to the principles of the present disclosure.
Figure 48:
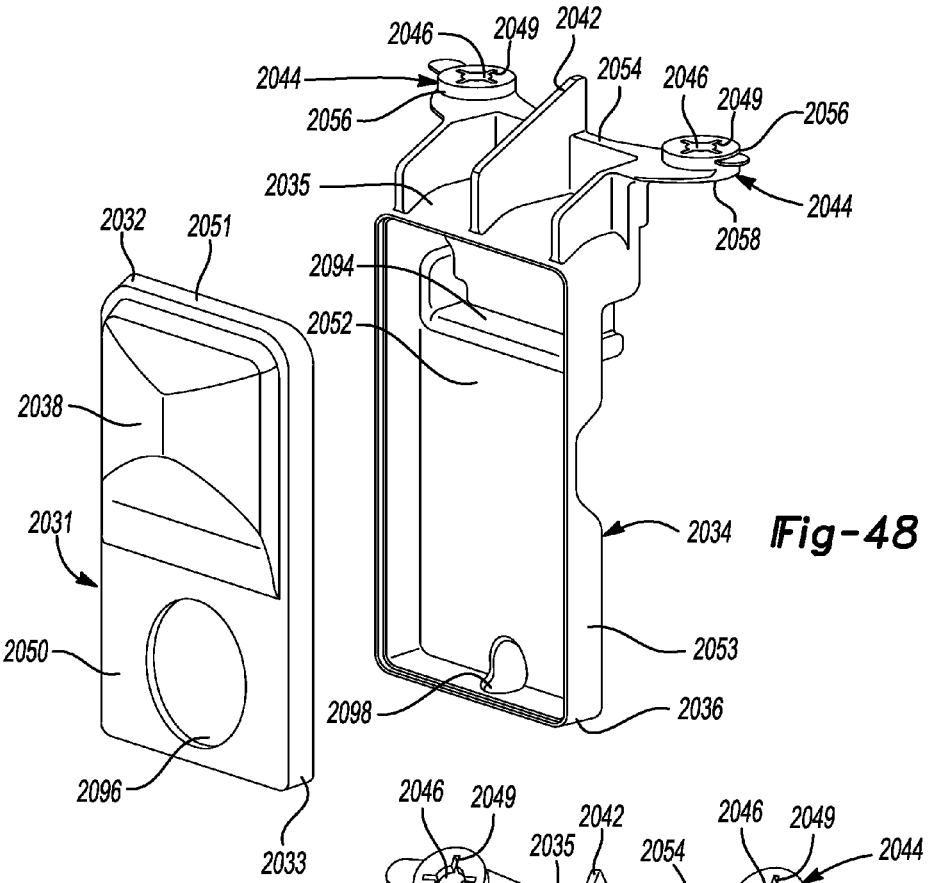
FIG. 48 is an exploded perspective view of the suction conduit of FIG. 47.
Figure 49:
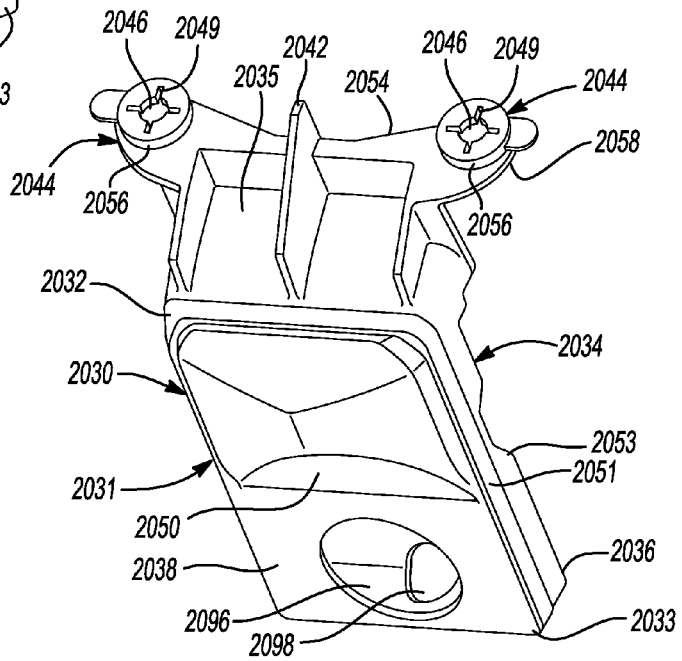
FIG. 49 is a perspective view of the suction conduit of FIG. 47.

Like the suction conduit 30, the suction conduit 2030 may be slightly spaced apart from the suction fitting 2028 and the shell assembly 2012 to form a gap 2040 therebetween (FIG. 47). A relatively small amount of working fluid may flow from the suction fitting 2028 through the gap 2040 and into a suction-pressure chamber 2039 of the compressor 2010. The gap 2040 may also reduce or prevent heat transfer between the suction fitting 2028 and the suction conduit 2030 and between the shell assembly 2012 and the suction conduit 2030 during assembly of the compressor 2010 (e.g., during welding processes attaching the suction fitting 2028 to the shell assembly 2012 and/or attaching components of the shell assembly 2012 to each other). Reducing or preventing heat transfer from the shell assembly 2012 to the suction conduit 2030 and/or from the suction fitting 2028 to the suction conduit 2030 during assembly of the compressor 2010 may reduce or prevent warping and/or other damage to the suction conduit 2030. This may be particularly beneficial when one or more components of the suction conduit 2030 are formed from a polymeric material.

The body portion 2050 may also include a bulge 2038 disposed between an upper edge 2032 of the rim portion 2051 and the inlet opening 2096. The bulge 2038 may protrude away from the second portion 2034. In the particular embodiment shown in FIGS. 47-52, the wall thickness of the body portion 2050 may be substantially constant.

The second portion 2034 may include a body portion 2052 and a mounting flange 2054. The body portion 2052 may include a rim portion 2053 that extends outward from the body portion 2052 toward the rim portion 2051 of the first portion 2031. The rim portions 2051, 2053 may engage each other and may be welded together and/or otherwise fixed to each other. A generally circular aperture 2098 may extend through the body portion 2052 and the rim portion 2053 and may be disposed at or proximate a lower edge 2036 of the body portion 2052. The aperture 2098 may provide a relatively small amount of fluid communication between the suction conduit 2030 and the suction-pressure chamber 2039.

The body portion 2052 and the mounting flange 2054 may cooperate to define an outlet 2094 having a generally rectangular shape. The outlet 2094 may be generally aligned with a suction inlet 2089 of the non-orbiting scroll 2072 to allow working fluid to flow through the suction conduit 2030 and enter the non-orbiting scroll 2072.

The mounting flange 2054 may include a vertically extending rib 2042 and a pair of outwardly extending mounting tabs 2044. The rib 2042 may be used to handle the suction conduit 2030 during installation onto the non-orbiting scroll 2072. That is, a worker or an assembly machine may grip the rib 2042 to position the suction conduit 2030 relative to the non-orbiting scroll 2072 before and/or while fastening the suction conduit 2030 to the non-orbiting scroll 2072. The rib 2042 may also be used to reinforce and strengthen the second portion 2034 during manufacturing and/or assembly of the suction conduit 2030, manufacturing of the compressor 2010 or operation of the compressor 2010.

The pair of mounting tabs 2044 may be positioned atop an upper edge 2035 of the second portion 2034 and may extend outwardly and away from the rib 2042. Each of the mounting tabs 2044 may include an upper surface 2056 and a lower surface 2058. The lower surface 2058 may engage the non-orbiting scroll 2072 and may include a pocket recess 2060 (FIGS. 51 and 52) that may extend a distance towards the upper surface 2056. An aperture 2046 may be formed in the upper surface 2056 of each mounting tab 2044 and may extend into the pocket recess 2060.

Each mounting tab 2044 may also include a plurality of slots 2049 extending radially outward from the aperture 2046. The particular configuration shown in FIG. 49 includes four equally spaced slots 2049 that cooperate to form a cross shape. In other configurations, each mounting tab 2044 may include more or fewer than four slots 2049 that are equally or unequally spaced apart from each other.

Figure 50:
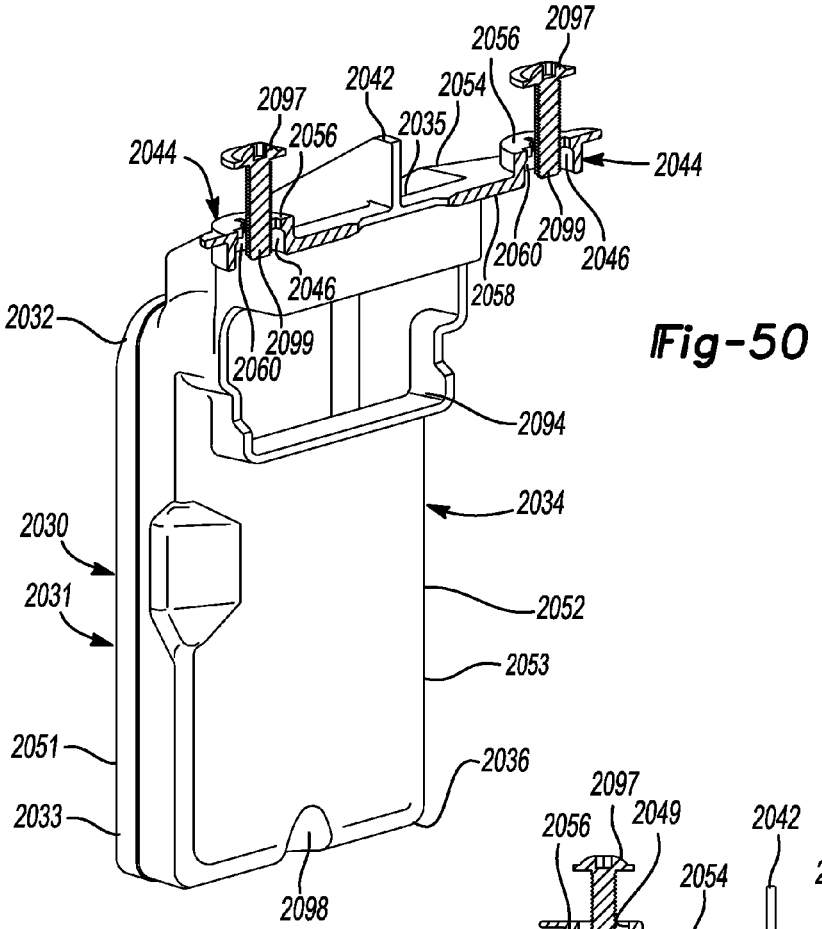
FIG. 50 is a cross-sectioned perspective view of the suction conduit of FIG. 47.
Figure 51:
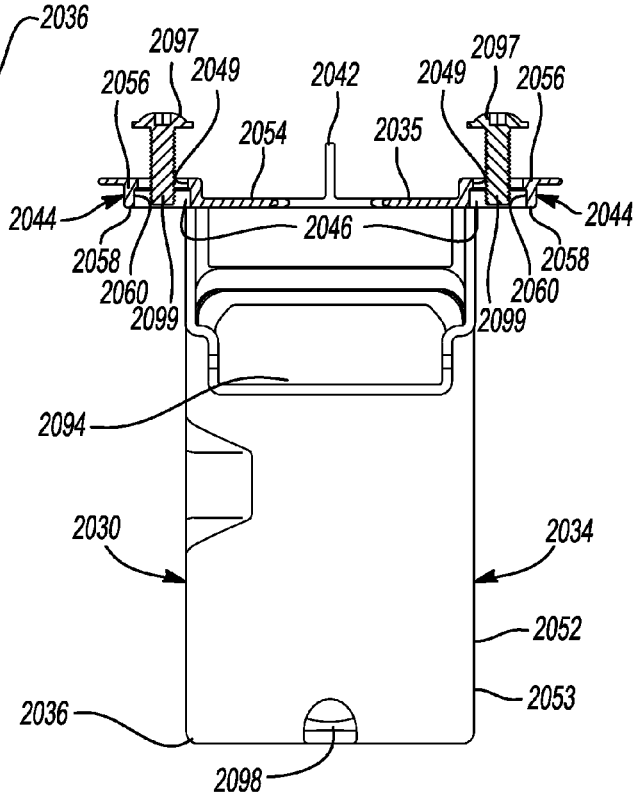
FIG. 51 is a cross-sectional view of the suction conduit of FIG. 47.
Figure 52:
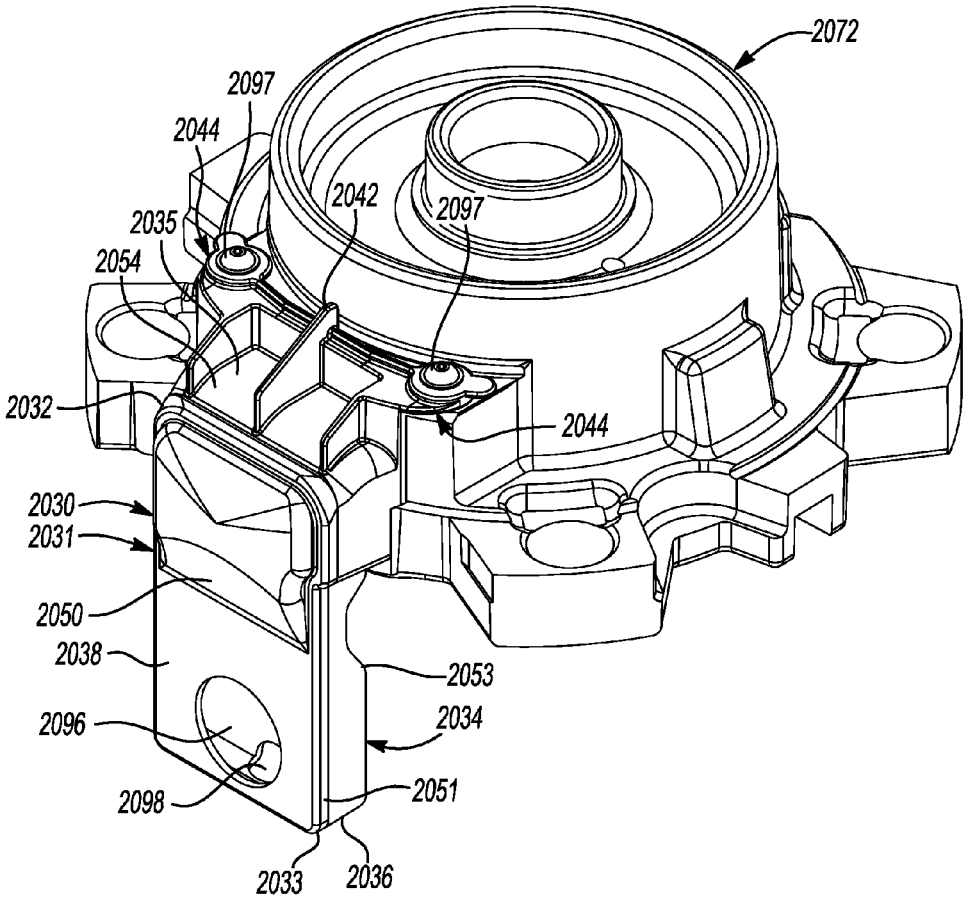
FIG. 52 is a perspective view of a non-orbiting scroll and the suction conduit of the compressor of FIG. 47.

As shown in FIGS. 50 and 51, prior to assembly of the suction conduit 2030 to the non-orbiting scroll 2072, a fastener 2097 may be disposed within each aperture 2046 such that a bottom portion 2099 of each fastener 2097 may be contained within a corresponding one of the pocket recesses 2060. In this position, the bottom portion 2099 of the fastener 2097 may not extend past the lower surface 2058 of each mounting tab 2042.

The shape of the apertures 2046 described above and the size of the apertures 2046 relative to the fasteners 2097 may allow the mounting tabs 2044 to releasably grip the fasteners 2097. This feature may help keep the fasteners 2097 from being misplaced or separated from the suction conduit 2030 prior to and/or during assembly of the compressor 2010. That is, the apertures 2046 may engage the fasteners 2097 and retain the bottom portion 2099 of the fasteners 2097 within each pocket recess 2060 therein until a worker or an assembly machine drives the fasteners 2097 into the non-orbiting scroll 2072. The assembly of the suction conduit 2030 to the non-orbiting scroll 2072 may occur either before or after the non-orbiting scroll 2072 is assembled to the compressor 2010.

Figure 53:
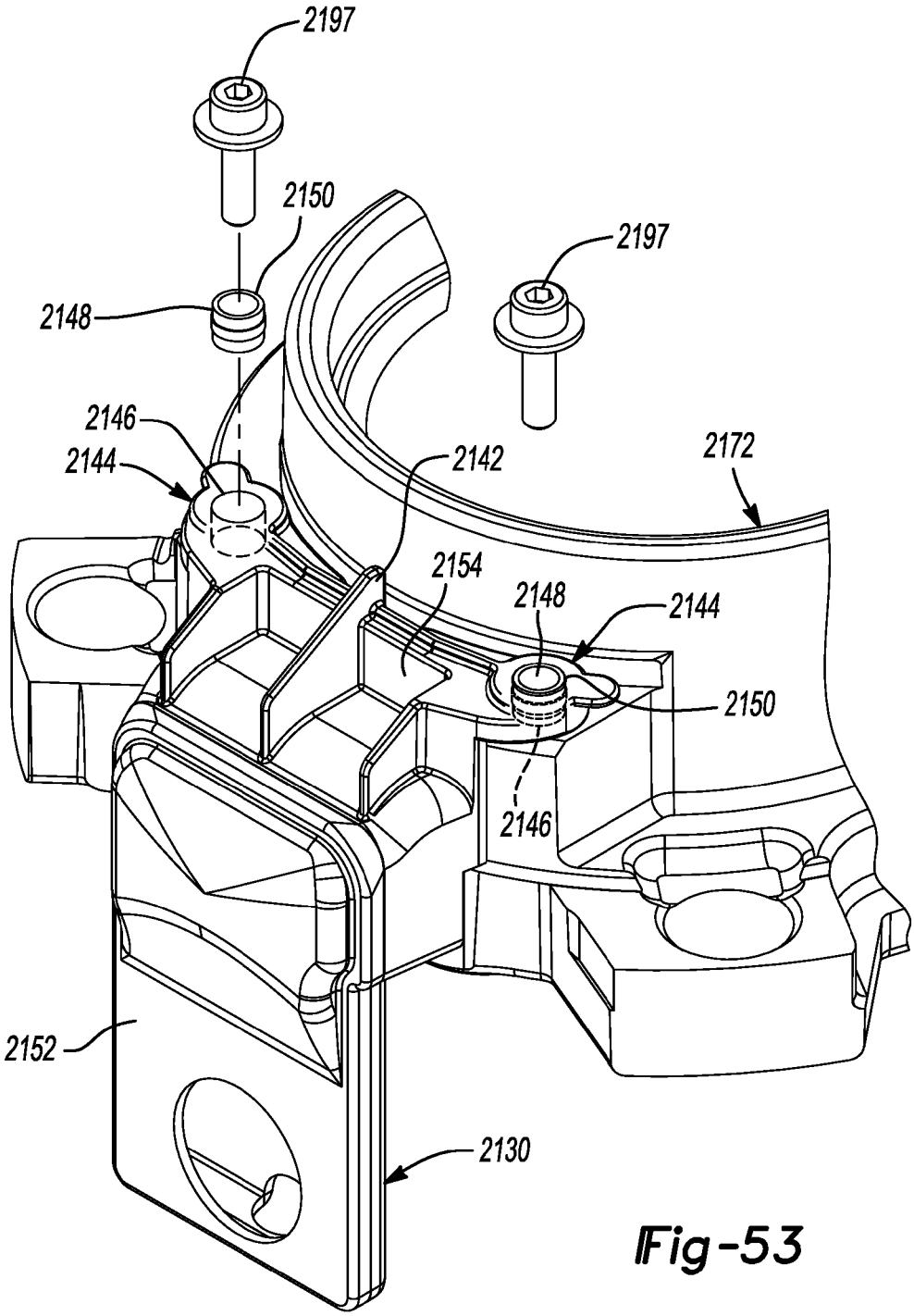
FIG. 53 is a partially exploded perspective view of another non-orbiting scroll and another suction conduit according to the principles of the present disclosure.

With reference to FIG. 53, another non-orbiting scroll 2172 and suction conduit 2130 are provided. The non-orbiting scroll 2172 and suction conduit 2130 may be incorporated into the compressor 10 or 2010 described above, for example. The structure and function of the non-orbiting scroll 2172 and suction conduit 2130 may be similar or identical to that of the non-orbiting scroll 2072 and suction conduit 2030, respectively, apart from any differences described below and/or shown in figures. Therefore, similar components and features will not be described again in detail.

Like the suction conduit 2030, the suction conduit 2130 may include a body portion 2152 and a mounting flange 2154. The body portion 2152 and the mounting flange 2154 may cooperate to define an outlet (not shown) that may sealingly engage a suction inlet (not shown) of the non-orbiting scroll 2172 to allow working fluid to flow through the suction conduit 2130 and enter the non-orbiting scroll 2172.

The mounting flange 2154 may include a vertically extending rib 2142 and a pair of outwardly extending mounting tabs 2144. The structure and function of the rib 2142 may be similar or identical to that of the rib 2042. Each of the mounting tabs 2144 may include an aperture 2146 extending therethrough. A bushing 2148 may be press-fit, threadably received or molded into each aperture 2146. The bushings 2148 may be brass, for example, or any other metallic or polymeric material. Fasteners 2197 may extend through the bushings 2148 and apertures 2146 and engage the non-orbiting scroll 2172 to secure the suction conduit 2130 to the non-orbiting scroll 2172. The fasteners 2197 may be torqued down against a top end 2150 of the bushings 2148. Therefore, forming the bushing 2148 from a metallic material may inhibit the fasteners 2197 from loosening over time.

Figure 54:
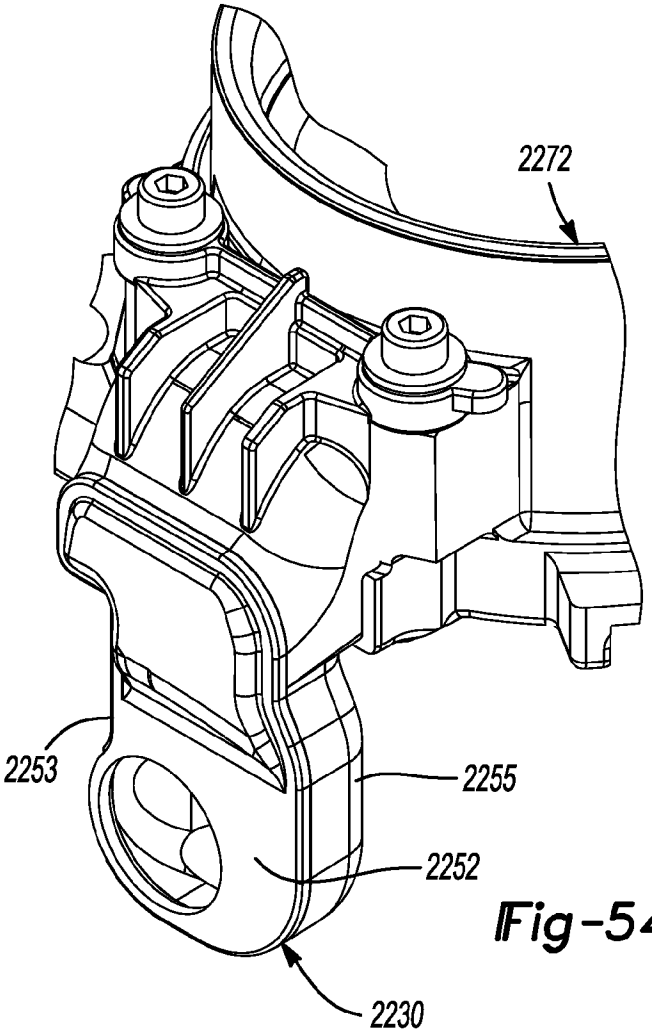
FIG. 54 is a perspective view of another non-orbiting scroll and another suction conduit according to the principles of the present disclosure.

With reference to FIG. 54, another non-orbiting scroll 2272 and suction conduit 2230 are provided. The non-orbiting scroll 2272 and suction conduit 2230 may be incorporated into the compressor 10 or 2010 described above, for example. The structure and function of the non-orbiting scroll 2272 and suction conduit 2230 may be similar or identical to that of the non-orbiting scrolls 2070, 2172 and suction conduits 2030, 2130 described above, apart from any differences described below and/or shown in figures. Therefore, similar components and features will not be described again in detail.

As shown in FIG. 54, the suction conduit 2272 may include a contoured body portion 2252 having a recessed portion 2253 and an outwardly bowed portion 2155. The contoured shape of the body portion 2252 may be configured to provide clearance for one or more components of the compressor in which the suction conduit 2230 is installed while still providing a desired volume within the suction conduit 2230 to allow for a desired mass flow rate therethrough. It will be appreciated that any of the suction conduits described herein could have additional or alternative contours and/or shapes to provide clearance for compressor components and facilitate desired mass flow rates therethrough.

Figure 55:
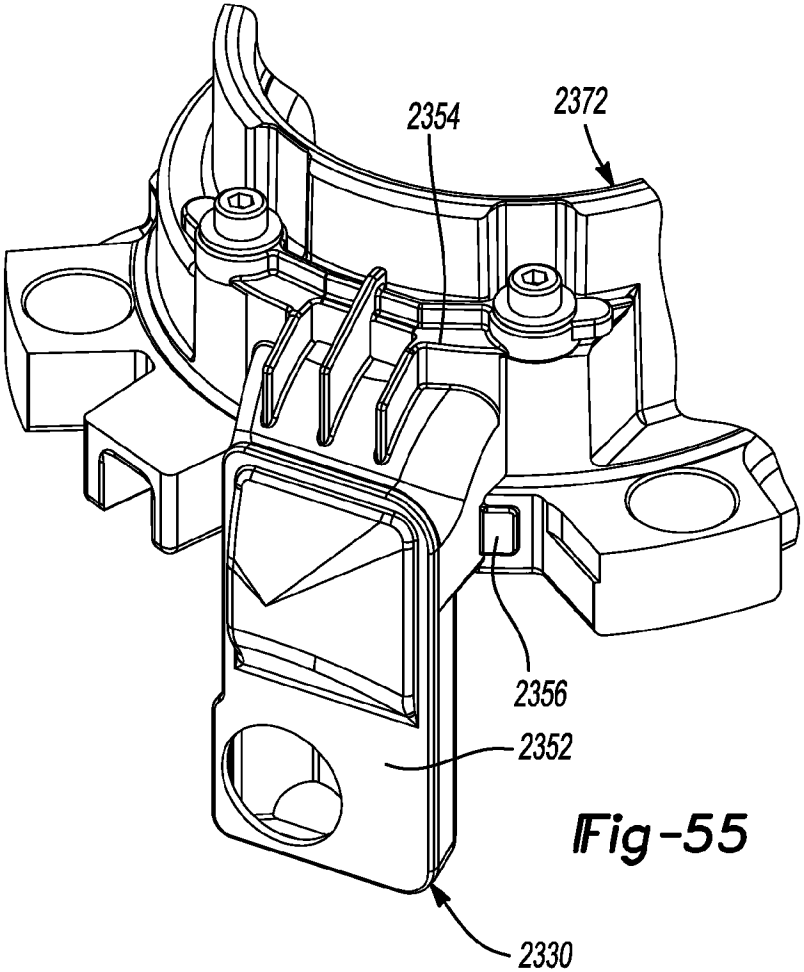
FIG. 55 is a partially exploded perspective view of another non-orbiting scroll and another suction conduit according to the principles of the present disclosure.

With reference to FIG. 55, another non-orbiting scroll 2372 and suction conduit 2330 are provided. The non-orbiting scroll 2372 and suction conduit 2330 may be incorporated into the compressor 10 or 2010 described above, for example. The structure and function of the non-orbiting scroll 2372 and suction conduit 2330 may be similar or identical to that of the non-orbiting scrolls 2070, 2172, 2272 and suction conduits 2030, 2130, 2230 described above, apart from any differences described below and/or shown in figures. Therefore, similar components and features will not be described again in detail.

Like the suction conduits 2030, 2130, 2230, the suction conduit 2330 may include a body portion 2352 and a mounting flange 2354. The body portion 2352 and the mounting flange 2354 may cooperate to define an outlet (not shown) that may engage a suction inlet (not shown) of the non-orbiting scroll 2372 to allow working fluid to flow through the suction conduit 2330 and enter the non-orbiting scroll 2372. The mounting flange 2354 may include a pair of tabs 2356 (only one of which is shown in FIG. 55) that extend laterally outward therefrom in opposite directions. The tabs 2356 may block fluid from flowing through gaps between the suction conduit 2330 and non-orbiting scroll 2372, thereby facilitating a sealed relationship between the outlet of the suction conduit 2330 and the suction inlet of the non-orbiting scroll 2372. In some embodiments, the mounting flange 2354 may include only one tab 2356 or more than two tabs 2356. The tabs 2356 may be provided to seal the suction conduit 2330 against a non-machined surface (e.g., an as-cast surface or an as-sintered surface) of the non-orbiting scroll 2372. It will be appreciated that the tabs 2356 could be provided to seal the suction conduit 2330 against a machined surface of the non-orbiting scroll 2372.

It will be appreciated that the principles of present disclosure are not limited in application to the scroll compressors described above. The suction conduits and directed suction concepts described above could be incorporated into other types of compressors, such as, for example, a reciprocating compressor, a rotary vane compressor, a linear compressor, or an open-drive compressor.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly having a fitting through which fluid is received from outside of the compressor, said shell assembly having a longitudinal axis;

a compression mechanism comprising a non-orbiting scroll disposed within a chamber defined by said shell assembly, said non-orbiting scroll haying a longitudinal axis that is parallel to said longitudinal axis of said shell assembly; and a conduit extending through said chamber between said fitting and a suction inlet of said compression mechanism and transmitting at least a portion of said fluid from said fitting to said suction inlet, said conduit including an inlet that is spaced apart from said fitting and an outlet that engages said compression mechanism, wherein said conduit includes a mounting flange having mounting apertures and a pair of tabs extending laterally outward from said mounting flange in opposite directions and sealing said conduit against a said non-orbiting scroll, said tabs are spaced apart from said mounting apertures in a direction parallel to said longitudinal axis of said shell assembly.

2. The compressor of claim 1, wherein said conduit includes a bulged portion, said inlet is disposed between said bulged portion and a longitudinal axis of said shell assembly.

3. The compressor of claim 2, wherein said conduit includes an integrally formed rib extending outward therefrom disposed proximate said outlet and between a pair of mounting apertures in said conduit, said rib extending vertically upward from said mounting flange such that an uppermost portion of said rib is disposed vertically higher than said mounting flange.

4. A compressor comprising:

a shell assembly having a fitting through which fluid is received from outside of the compressor, said shell assembly having a longitudinal axis;

a compression mechanism comprising a non-orbiting scroll disposed within a chamber defined by said shell assembly, said non-orbiting scroll having a longitudinal axis that is parallel to said longitudinal axis of said shell assembly; and a conduit extending through said chamber between said fitting and a suction inlet of said compression mechanism and transmitting at least a portion of said fluid from said fitting to said suction inlet, said conduit including an inlet that is spaced apart from said fitting and an outlet that engages said compression mechanism, said conduit including a bulged portion, said inlet is disposed radially between said bulged portion and said longitudinal axis of said shell assembly, wherein said conduit includes a mounting flange having mounting apertures and a pair of tabs extending laterally outward from said mounting flange in opposite directions and sealing said conduit against said non-orbiting scroll, wherein said tabs are spaced apart from said mounting apertures in a direction parallel to said longitudinal axis of said shell assembly.

5. The compressor of claim 4, wherein said conduit includes an aperture spaced apart from said inlet and said outlet and providing fluid communication between said conduit and said chamber.

6. The compressor of claim 4, wherein said conduit is spaced apart from said fitting and said shell assembly.

7. The compressor of claim 4, wherein said conduit includes an integrally formed rib extending outward therefrom.

8. The compressor of claim 7, wherein said rib is disposed proximate said outlet and between a pair of mounting apertures in said conduit.

9. The compressor of claim 8, wherein said rib extends from the mounting flange in a direction perpendicular to said tabs.

10. The compressor of claim 9, wherein said conduit includes a pair of threaded bushings receiving fasteners that fixedly secure said conduit to a non-orbiting scroll.

11. The compressor of claim 4, wherein said conduit includes a mounting flange having a pair of threaded bushings receiving fasteners that fixedly secure said conduit to a non-orbiting scroll.

12. A compressor comprising:

a shell assembly having a fitting through which fluid is received from outside of the compressor, said shell assembly having a longitudinal axis;

a compression mechanism comprising a non-orbiting scroll disposed within a chamber defined by said shell assembly, said non-orbiting scroll haying a longitudinal axis that is parallel to said longitudinal axis of said shell assembly; and a conduit extending through said chamber between said fitting and a suction inlet of said compression mechanism and transmitting at least a portion of said fluid from said fitting to said suction inlet, said conduit including an inlet that is spaced apart from said fitting and an outlet that engages said compression mechanism, said conduit including an aperture spaced apart from said inlet and said outlet and providing fluid communication between said conduit and said chamber, said conduit including a bulged portion, said inlet is disposed radially between said bulged portion and said longitudinal axis of said shell assembly, said conduit including a mounting flange having mounting apertures and a pair of sealing tabs extending laterally outward from said mounting flange in opposite directions and sealing said conduit against said non-orbiting scroll, wherein said conduit includes an integrally formed rib extending outward therefrom, said rib is disposed proximate said outlet and between a pair of mounting tabs on said mounting flange, wherein said mounting apertures extend through said mounting tabs, wherein said rib extends from the mounting flange in a direction perpendicular to said sealing tabs, said rib extends vertically upward from said mounting flange such that an uppermost portion of said rib is disposed vertically higher than said mounting flange such that said outlet of said conduit is disposed vertically between said inlet of said conduit and an uppermost edge of said rib, wherein said sealing tabs are spaced apart from said mounting tabs and said mounting apertures, said sealing tabs are disposed in a different plane than said mounting tabs.

13. The compressor of claim 12, wherein said conduit is spaced apart from said fitting and said shell assembly.

14. The compressor of claim 12, wherein said mounting flange includes a pair of threaded bushings receiving fasteners that fixedly secure said conduit to a non-orbiting scroll.

* * * * *